US010413089B2

(12) United States Patent
Rajasekaran et al.

(10) Patent No.: US 10,413,089 B2
(45) Date of Patent: Sep. 17, 2019

(54) CUTLERY DISPENSER

(71) Applicant: Recycline, Inc., Waltham, MA (US)

(72) Inventors: Mohan Rajasekaran, Bristol, CT (US); Aaron Szymanski, Thomaston, CT (US); Eric Hudson, Acton, MA (US); John Lively, Cambridge, MA (US)

(73) Assignee: Recycline, Inc., Waltham, MA (US)

( * ) Notice: Subject to any disclaimer, the term of this patent is extended or adjusted under 35 U.S.C. 154(b) by 141 days.

(21) Appl. No.: 15/850,182

(22) Filed: Dec. 21, 2017

(65) Prior Publication Data

US 2019/0191893 A1 Jun. 27, 2019

(51) Int. Cl.
*A47F 1/10* (2006.01)
*A47F 1/08* (2006.01)

(52) U.S. Cl.
CPC ..... *A47F 1/10* (2013.01); *A47F 1/085* (2013.01); *A47F 2001/103* (2013.01)

(58) Field of Classification Search
CPC ... A61J 7/0076; B60P 3/0257; G06F 19/3462; G06G 30/0207; G06G 30/0266
See application file for complete search history.

(56) References Cited

U.S. PATENT DOCUMENTS 592,105 A 10/1897 Barnes
925,485 A 6/1909 Lafler
999,837 A 8/1911 Morris et al.
1,355,583 A 10/1920 Zeidler et al.
1,504,098 A 8/1924 Cathey
1,675,510 A 7/1928 Nolan
2,141,684 A 12/1938 Diemer
2,188,573 A 1/1940 Longo
2,207,528 A 7/1940 Witt
2,239,196 A 4/1941 Lunvik
2,268,596 A 1/1942 Jerum
2,911,127 A 11/1959 Driss et al.
3,028,048 A * 4/1962 Klammer ..... A47G 21/14 221/293
3,132,765 A 5/1964 Florendo
(Continued)

FOREIGN PATENT DOCUMENTS

EP 0856272 A2 8/1998

*Primary Examiner* — Jacob S. Scott
*Assistant Examiner* — Ayodeji T Ojofeitimi
(74) *Attorney, Agent, or Firm* — Thomas P. O'Connell; O'Connell Law Firm

(57) ABSTRACT

A utensil dispenser that selectively dispenses a lowermost utensil from a stack of utensils. A main housing retains plural dispensing chambers. A selectively operable dispensing mechanism has a movable support structure, an actuated support structure, and an actuation structure retained by a manual actuator. First and second arms form the movable support structure with distal portions that are in proximity to support the lowermost utensil when in a first condition and that are separated when in a second condition. A shelf member retained by the actuator forms the actuated support structure to be selectively interposed between the lowermost and second lowermost utensil. An actuation structure, such as opposed ramp surfaces, is retained by the actuator to separate the first and second arms on actuation of the actuator. When the actuator is actuated, the stack of utensils, except for the lowermost utensil, is supported so that the lowermost utensil is dispensed.

36 Claims, 16 Drawing Sheets

(56) References Cited

U.S. PATENT DOCUMENTS

| | | | | |
|---|---|---|---|---|
| 3,263,860 | A | 8/1966 | Haas | |
| 3,313,452 | A | 4/1967 | Katz | |
| 3,472,421 | A | 10/1969 | Baller | |
| 3,587,922 | A | 6/1971 | Oriti | |
| 4,134,519 | A * | 1/1979 | Barnett | A47F 1/08 221/155 |
| 4,489,854 | A | 12/1984 | Wenkman et al. | |
| 5,921,408 | A | 7/1999 | Groenewold et al. | |
| 6,202,891 | B1 | 3/2001 | Mark | |
| 6,336,568 | B1 * | 1/2002 | Tucker | A47F 1/10 221/131 |
| 6,832,694 | B2 | 12/2004 | Goeking et al. | |
| 8,152,004 | B2 | 4/2012 | Smith et al. | |
| 8,210,364 | B2 | 7/2012 | Smith et al. | |
| 8,272,533 | B1 * | 9/2012 | D'Amelia | A47F 1/10 221/172 |
| 9,049,948 | B2 | 6/2015 | Jongen et al. | |
| 2004/0089670 | A1 * | 5/2004 | Goeking | A47F 1/10 221/123 |
| 2007/0108141 | A1 * | 5/2007 | Smith | A47F 1/10 211/49.1 |
| 2008/0121650 | A1 | 5/2008 | Smith | |
| 2010/0084418 | A1 * | 4/2010 | Reinsel | A47F 1/10 221/1 |
| 2010/0170915 | A1 * | 7/2010 | Reinsel | A47F 1/10 221/279 |
| 2011/0226797 | A1 * | 9/2011 | Reinsel | A47F 1/10 221/97 |
| 2012/0080444 | A1 * | 4/2012 | Smith | A47F 1/10 221/208 |
| 2012/0145734 | A1 * | 6/2012 | Walters | A47F 1/10 221/1 |
| 2012/0145735 | A1 * | 6/2012 | Erickson | A47F 1/10 221/1 |
| 2012/0145736 | A1 * | 6/2012 | Walters | A47F 1/10 221/1 |
| 2013/0193157 | A1 * | 8/2013 | Jongen | A47F 1/08 221/23 |
| 2014/0117036 | A1 * | 5/2014 | Smith | A47F 1/10 221/1 |
| 2015/0289679 | A1 * | 10/2015 | Oakes | A47F 1/125 221/1 |
| 2018/0000261 | A1 * | 1/2018 | Smith | A47F 1/10 |

* cited by examiner

CUTLERY DISPENSER

FIELD OF THE INVENTION

The present invention relates generally to dispensing devices. More particularly, disclosed herein is a dispenser for utensils, such as disposable or recyclable cutlery, that is efficient and reliable in operation to permit utensils to be loaded, retained, and dispensed, one utensil per actuation, conveniently and hygienically.

BACKGROUND OF THE INVENTION

Disposable and recyclable utensils, such as plastic spoons, forks, knives, and hybrids thereof, are frequently provided to customers, employees, students, and others in informal settings, such as casual restaurants, take-out eateries, and school and business cafeterias. A number of issues have been recognized with respect to such cutlery, particularly where it is available to consumers on a self-service basis. Among the most basic needs with respect to the retention and dispensing of cutlery is that the cutlery be maintained in a hygienic condition pending retrieval by a given consumer. A further need that has come to be well recognized relates to the conservation of resources so that consumers are likely to obtain only the number and type of utensils for which he or she actually expects to need. Of course, a further preference of establishments and consumers alike is that the cutlery can be obtained by the consumer quickly and conveniently.

Under the prior art, one method for ensuring that cutlery is provided in hygienic form is for it to be purchased and distributed in a sealed pouch. The pouch is often designed to have all of the components that the typical consumer might require, such as a fork, a knife, a spoon, or a combination utensil, and potentially a napkin, condiments, and even a cleansing wipe. While the contents of such pouches are likely to be maintained in a sanitary condition, the pouches suffer from a number of disadvantages. For example, they are prone to include by default one or more components for which the consumer has no need or desire. Those components are typically unused and simply discarded. Furthermore, separate manufacturing steps and materials must be employed to produce the pouch and to envelop the components therewithin. Still further, while the contents of the pouches may indeed be maintained in a sanitary manner, there is no such guarantee for the pouches themselves, which may well be rummaged through by multiple customers of varying hand cleanliness before being selected by the ultimate user.

Rather than providing cutlery in pouches, establishments may opt to make utensils available in unwrapped form, such as in bins separated by cutlery type. The selection of cutlery directly from the bins permits the consumer to select only the utensils likely to be used. However, the utensils are exposed not only to airborne contaminants but also to contamination and, perhaps equally importantly, the perception of contamination deriving from innumerable consumers, each of unknown cleanliness, reaching into the pile of utensils to obtain the one he or she ultimately selects. Furthermore, this method of dispensing cutlery permits the consumer to grab multiple utensils by the handful thereby leading to further expense for the establishment. Still further, where potentially hundreds of utensils rest in a single bin, a contamination event, such as a spill or the like, may require that the entire contents of the bin be disposed of, which leads to still further waste.

With these and further issues relating to prior art methods of distributing cutlery known, a number of skilled inventors have sought to provide cutlery dispensers that permit cutlery to be retained in a hygienic manner pending distribution. Such cutlery dispensers generally have sought to dispense individual pieces of cutlery in a manner overcoming the waste and inefficiencies summarized above.

In 1935, for instance, J. A. Diemer disclosed a Dispensing Device with U.S. Pat. No. 2,141,684 that employed a partitioned cabinet retaining stacks of utensils. Utensils from each stack of utensils could be dispensed by actuation of a plunger. In operation, the plunger would seek to raise the entire stack of utensils but for the lowermost utensil while simultaneously sliding the lowermost utensil backward until its anterior end slid off of a shelf. A that point, the utensil would, assuming proper operation of the dispensing device, be pivotally suspended by its posterior end to be grasped by the user.

Effective and reliable operation of the dispenser of the '684 patent relied on a plurality of contingencies. For example, it was necessary for the sharp tip of the plunger to engage the utensil to be dispensed in a direct, endwise relationship, which was challenging at best and would vary in degree of practicality depending on the type of utensil to be dispensed. Moreover, requiring the plunger not only to press a given utensil backwardly but also to lift an entire stack of utensils, which could itself be jammed or otherwise difficult to move, introduced another source of malfunction. Still further, the ability of a user to grasp the utensil sought to be dispensed hinged on its actually pivoting downwardly to be perceived by the consumer and not being obstructed. Diemer's and other utensil dispensers of the prior art are vulnerable to malfunction.

Other utensil dispensers have been disclosed wherein utensils must be individually loaded into the dispenser. For instance, U.S. Pat. No. 6,832,694 teaches a cutlery dispenser wherein a lowermost utensil is dispensed by being slid with respect to the remainder of the stack. In one embodiment, an actuating member moves a shaft portion that in turn moves a translating portion. The translating portion pivots to cause a pushing portion to rotate toward the utensil and then to move the utensil to fall through a dispensing opening. This dispensing operation is characterized as requiring relatively little dispensing force and promoting easy and reliable dispensing. However, the '694 patent is interpreted to demand the individual loading of utensils into the dispenser, which is time consuming and introduces the opportunity for incorrect loading and resultant jamming. Further, with individual handling, a further source of contamination is introduced. Other utensil dispensers of the prior art are similarly limited.

Certain disclosed utensil dispensers have required that utensils be pre-loaded into a cartridge and mounted in the machine within the cartridge. With the requirement of a cartridge, additional expense and complication are introduced. Moreover, where a cartridge is employed, it would ideally be fully emptied before being replaced with a new, fully loaded cartridge. However, to avoid having the dispenser exhausted of utensils at an inopportune time, such as during a mealtime rush, the establishment might deem it necessary to replace and dispose of a cartridge before it is fully empty so that a full load of utensils will be available. Such systems thus increase the inconvenience and cost of supplying cutlery to the consumer.

Many of the foregoing and other utensil dispensers of the prior art are complex in structure and operation. Such complexity leads to excess expense in manufacture and purchase. Furthermore, structurally complex dispensers are prone to malfunction and can be complex in usage and repair.

Utensil dispensers are also known, such as through U.S. Pat. No. 8,152,004, wherein stacks of cutlery must be adhered or bonded together prior to loading and, potentially, dispensing. With that, adhesive strips, adhesive itself, or other bonding material is introduced into the system, which adds further complication and another source of potential malfunction. Furthermore, residual adhesive left on an article of cutlery may well give the impression to the consumer that the article of cutlery that was sought to be hygienically retained and individually dispensed is less than sanitary. Still other disclosed utensil dispensers, such as that of U.S. Pat. No. 8,210,364, have required specially formed utensils to permit their stacking and dispensing. This introduces still further expense in tooling and manufacture.

It is thus apparent that there remains a recognized need for a structurally and ergonomically efficient utensil dispenser that is reliable in operation to permit utensils to be retained and dispensed in a convenient and hygienic manner with reduced waste.

SUMMARY OF THE INVENTION

In view of the foregoing, the present inventors set forth with the basic object of providing a dispenser for utensils that is efficient and reliable in operation.

Another object of the invention is to provide a utensil dispenser that permits utensils to be loaded, retained, and dispensed conveniently and hygienically.

A further object of the invention is to provide a utensil dispenser that reduces waste and provides a mechanism for inventory control by effectively dispensing one utensil of a selected type per actuation.

Still another object of embodiments of the invention is to provide a utensil dispenser that can be loaded with stacks of utensils to be dispensed quickly and conveniently and in a manner that prevents contamination of utensils during loading, retention, and dispensing.

These and further objects and advantages of embodiments of the invention will become obvious not only to one who reviews the present specification and drawings but also to one who has an opportunity to make use of an embodiment of the utensil dispenser disclosed herein. It will be appreciated, however, that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the invention.

In carrying forth one or more objects of the invention, an embodiment of the utensil dispenser is founded on a main housing. The main housing has a plurality of utensil chamber bays. For instance, the main housing can have first, second, third, and fourth dispensing chambers and a main housing with first, second, third, and fourth utensil chamber bays for detachably receiving and retaining the first, second, third, and fourth dispensing chambers. Each utensil dispensing chamber is operative to dispense a lowermost utensil from a stack of utensils loaded within the utensil dispenser. Each utensil has a working end and a handle portion.

Each dispensing chamber has a utensil channel adapted, such as by peripheral shape and size, to receive and retain a stack of utensils. The utensil channel has a first or upper end and a second end, which acts as a dispensing end. A dispensing mechanism is selectively operable relative to the dispensing end of the utensil channel to dispense the lowermost utensil from the stack of utensils. In one practice of the invention, the dispensing mechanism has a movable support structure, an actuated support structure, and an actuator.

The movable support structure has a first condition wherein the movable support structure is disposed in a support position with respect to the dispensing end of the utensil channel to support the lowermost utensil and a second condition wherein the movable support structure is moved out of the support position with respect to the dispensing end of the utensil channel such that the movable support structure does not provide support to the lowermost utensil. The actuated support structure has a first position wherein the actuated support structure is not disposed to support the stack of utensils and a second position wherein the actuated support structure is interposed between the lowermost utensil and a second lowermost utensil above the lowermost utensil to provide support to the stack of utensils above the lowermost utensil by direct support of the second lowermost utensil.

An actuator is selectively adjustable from a non-actuated condition to an actuated condition. Adjustment of the actuator to the actuated condition causes the actuator to induce the movable support structure from the first condition to the second condition. Furthermore, the actuator operates to reposition the actuated support structure from the first position to the second position whereby, when the actuator is in the actuated condition, the stack of utensils above the lowermost utensil is supported by the actuated support structure while the lowermost utensil is supported by neither the movable support structure nor the actuated support structure.

In embodiments of the utensil dispenser, a fixed support structure is disposed in the dispensing end of the utensil channel. The fixed support structure is spaced from the dispensing mechanism and is operative to support the lowermost utensil of the stack of utensils spaced from the dispensing mechanism. For example, the fixed support structure can take the form of a shelf fixed in the dispensing channel, such as to engage tip portions of working ends of the utensils.

The utensil channel has a shape corresponding to a peripheral shape of the working end of the utensil. The utensil channel further includes a longitudinal slot in the first dispensing chamber contiguous with the shape corresponding to the peripheral shape of the working end of the utensil in the utensil channel. The longitudinal slot is disposed to receive the handle portions of the utensils of the stack of utensils, and the fixed support structure is disposed to support a tip of the working end of the utensil. Furthermore, the movable support structure and the actuated support structure are disposed to align with the handle portions of the utensils of the stack of utensils. For instance, the movable support structure can selectively engage the proximal ends of the handles of the utensils as a temporary shelf, and the movable support structure can comprise pivotable arms disposed in opposition with distal portions that selectively support the handles of the utensils.

The actuator can be a manual actuator that is repositionable from a first condition or position wherein the actuator is not actuated to a second condition or position wherein the actuator is actuated. An actuation structure is retained to move into engagement with the movable support structure when the actuator is repositioned from the first condition to the second condition, and the actuation structure is operable to induce the movable support structure from the first condition to the second condition when the actuator is repositioned from the first condition to the second condition. For example, the actuated support structure can be retained by the actuator to move from the first position into the second position when the actuator is repositioned from the first condition to the second condition. In a similar manner, the actuation structure can be retained by the actuator. The positions of the movable support structure and the actuated support structure can be interdependent.

Also as disclosed herein, the first dispensing chamber can have a utensil chamber body and a utensil chamber cover that can be selectively engaged with the utensil chamber body. In such embodiments, the utensil channel may be in the utensil chamber body. Stacks of utensils can be loaded into the utensil chamber with the working ends of the utensils longitudinally aligned within the utensil channel and the handles of the utensils projecting through the longitudinal slot in the utensil chamber. For example, as taught herein, the handle portions of the utensils of the stack of utensils can be retained for installation in removable sleeves.

The movable support structure comprises at least one member with a distal portion that is disposed in the support position with respect to the dispensing portion of the utensil channel to support the lowermost utensil when the movable support structure is in the first condition and that is moved out of the support position with respect to the dispensing portion of the utensil channel so that the movable support structure does not provide support to the lowermost utensil when the movable support structure is in the second condition.

The utensil channel can be considered to have a central plane substantially aligned with the handles of the utensils. The movable support structure can take the form of first and second members disposed in opposition with respect to the central plane. The first and second members can, for example, be first and second arms pivotable about pivot axes. Each of the first and second members has a distal portion. The distal portions of the first and second members are disposed in proximity when the movable support structure is in the first condition, and the distal portions of the first and second members are moved away from one another when the movable support structure is in the second condition. When in proximity, the distal ends of the arms present a substantially continuous, flat support surface.

As taught herein, the actuation structure can take the form of first and second ramp surfaces that face outwardly with respect to a central plane of the utensil channel. The first and second ramp surfaces progressively increase in effective distance between the ramp surfaces. For instance, the ramp surfaces can increase in the effective distance between them from a minimum at distal portions of the ramp surfaces sufficient to permit the ramp surfaces to be received between the first and second members to a maximum sufficiently greater than a distance between portions of the first and second members engaged by the ramps of the actuation structure to cause the tips of the distal portions of the first and second members to be separated, such as by a distance greater than a width of the corresponding portions of the handles of the utensils.

With the actuated support structure retained by the actuator to move from the first position into the second position when the actuator is repositioned from the first condition to the second condition, the actuated support structure can be substantially centered between the ramp surfaces. Further, the actuated support structure can increase thickness from a distal end or tip of the actuated support structure so that the actuated support structure can most effectively be received lengthwise between the proximal ends of the handles of the utensils. The distal tip of the actuated support structure can, as disclosed herein, be aligned with respect to the support surface formed by the distal portions of the first and second members to be received in the separation distance immediately above the handle portion of the lowermost utensil.

In a particular embodiment of the utensil dispenser, the dispenser is again operative to dispense a lowermost utensil from a stack of utensils loaded within the utensil dispenser, each utensil with a working end with a distal tip and a handle portion with a proximal end. The utensil dispenser has a dispensing chamber with a utensil channel therein adapted to receive and retain the stack of utensils. The utensil channel has a dispensing portion and a shape corresponding to a peripheral shape of the working end of the utensil. The utensil channel further has a longitudinal slot contiguous with the peripheral shape of the working end of the utensil for receiving the handle portions of the utensils of the stack of utensils.

A dispensing mechanism is selectively operable relative to the dispensing portion of the utensil channel to dispense the lowermost utensil from the stack of utensils by operation of a manual actuator. A movable support structure comprises at least one movable member with a first condition wherein the at least one movable member is disposed in a support position with respect to the dispensing portion of the utensil channel to support the lowermost utensil and a second condition wherein the at least one movable member is moved out of the support position with respect to the dispensing portion of the utensil channel so that the at least one movable member does not provide support to the lowermost utensil. An actuated support structure has a first position wherein the actuated support structure is not disposed to support the stack of utensils to a second position wherein the actuated support structure is interposed between the lowermost utensil and a second lowermost utensil above the lowermost utensil to provide support to the stack of utensils above the lowermost utensil by direct support of the second lowermost utensil.

The manual actuator is selectively repositionable from a first position wherein the manual actuator is not actuated to a second, actuated position wherein the manual actuator is actuated. The manual actuator is operative to induce the movable support structure from the first condition to the second condition and the actuated support structure from the first position to the second position. With that, when the manual actuator is in the actuated condition, the stack of utensils above the lowermost utensil is supported by the actuated support structure while the lowermost utensil is supported by neither the movable support structure nor the actuated support structure. In such constructions of the utensil dispenser, an actuation structure can be retained by the manual actuator to move into engagement with the movable support structure when the manual actuator is repositioned from the first condition to the second condition. The actuation structure is operable to induce the movable support structure from the first condition to the second condition when the actuator is repositioned from the first condition to the second condition. The actuated support structure, which can effectively form a temporary shelf, is retained by the manual actuator to move from the first position into the second position when the manual actuator is repositioned from the first condition to the second condition.

One will appreciate that the foregoing discussion broadly outlines the more important features of the invention merely to enable a better understanding of the detailed description that follows and to instill a better appreciation of the inventors' contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

The utensil dispenser disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 1:
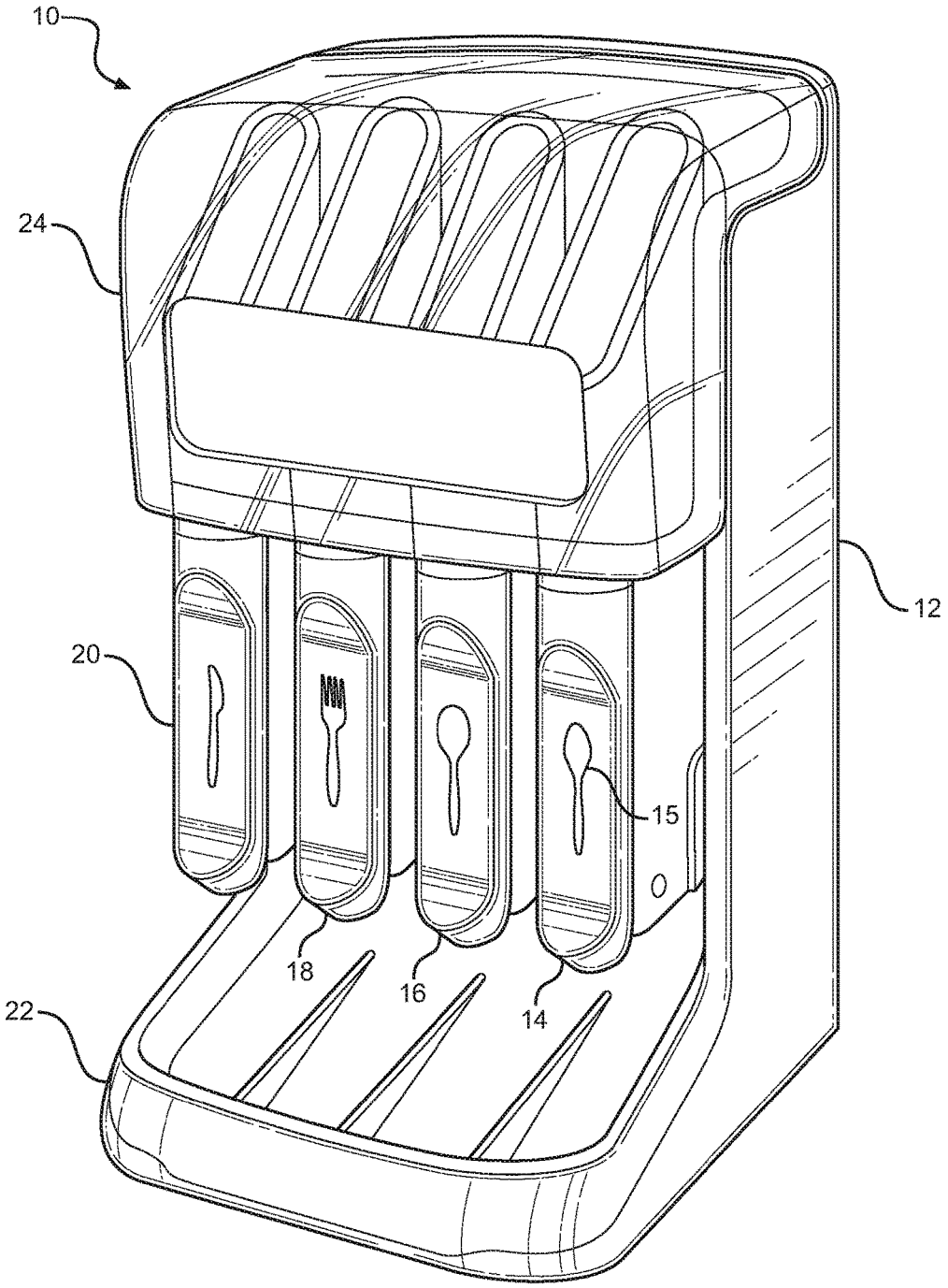
FIG. 1 is a perspective view of a utensil dispenser according to the present invention.
Figure 2:
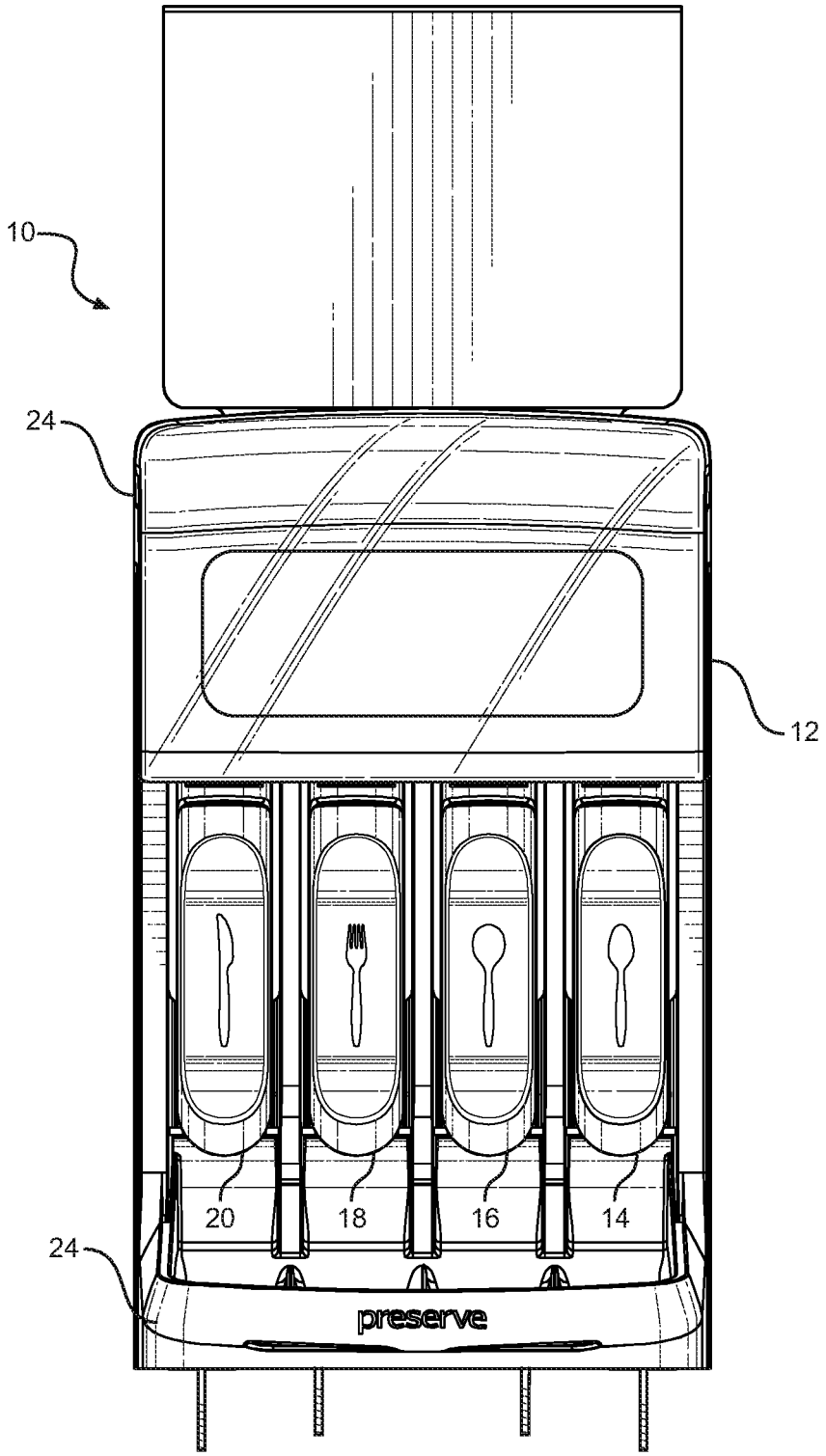
FIG. 2 is a view in front elevation of a utensil dispenser as disclosed herein.
Figure 3:
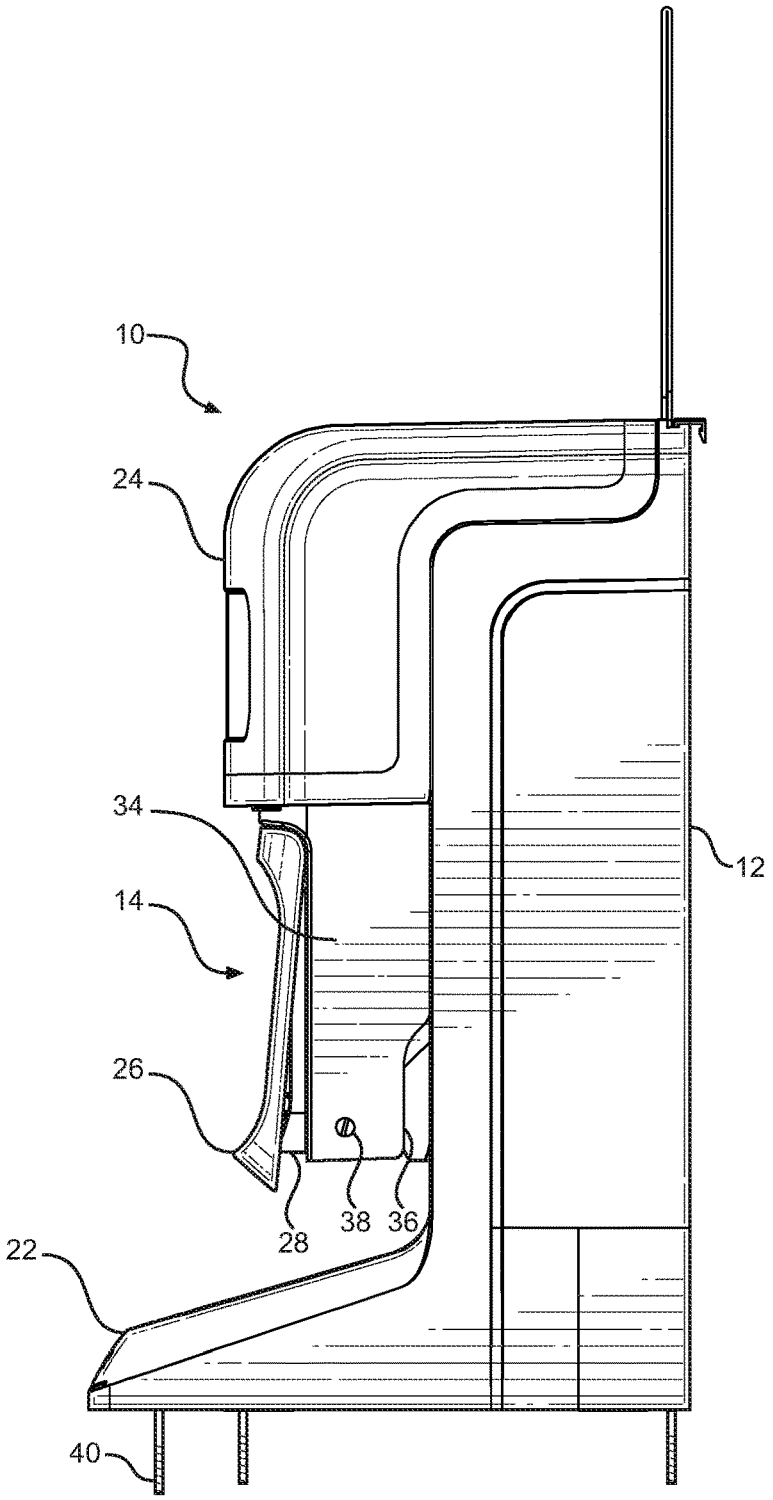
FIG. 3 is a sectioned view in side elevation of the utensil dispenser.

Looking more particularly to the drawings, a utensil dispenser according to the disclosed invention is indicated generally at 10 in FIGS. 1 and 2. There, the utensil dispenser 10 is founded on a main housing 12. The housing 12 retains a plurality of utensil dispensing chambers 14, 16, 18, and 20. Representations 15 indicative of the utensils to be retained are disposed on each of the dispensing chambers 14, 16, 18, and 20.

In the depicted embodiment of FIGS. 1 and 2, the dispensing chambers 14, 16, 18, and 20 are respectively constructed for the retention and dispensing of cutlery, specifically teaspoons, soup spoons, forks, and knives, so that the utensil dispenser 10 may alternatively be referred to as a cutlery dispenser 10. It will be understood, however, that other cutlery and other utensils could be retained and dispensed and that one or more of the chambers 14, 16, 18, or 20 could retain the same utensils as might be warranted by a given application. Furthermore, fewer or more utensil chambers 14, 16, 18, and 20 could be provided within the scope of the invention.

As shown and described further herein, each dispensing chamber 14, 16, 18, and 20 can be selectively actuated to dispense utensils loaded therein. One utensil is dispensed per actuation. The utensil so dispensed falls under the force of gravity from the respective chamber 14, 16, 18, or 20. The utensils can, for instance, fall into a reception and dispensing tray 22 retained by the main housing 12 below the chambers 14, 16, 18, and 20. The reception and dispensing tray 22 is removable, such as for cleaning. A lid 24 enshrouds upper portions of the dispensing chambers 14, 16, 18, and 20 and the main housing 12. The lid 24, which can be transparent or translucent, is selectively removable in relation to the chambers 14, 16, 18, and 20 and the main housing 12, such as to permit installation and replacement of the several chambers 14, 16, 18, and 20 and a loading of utensils into the chambers 14, 16, 18, and 20. When the lid 24 is affixed to the main housing 12, the retained utensils 102 cannot be accessed except through dispensing actuation as taught herein.

Figure 4:
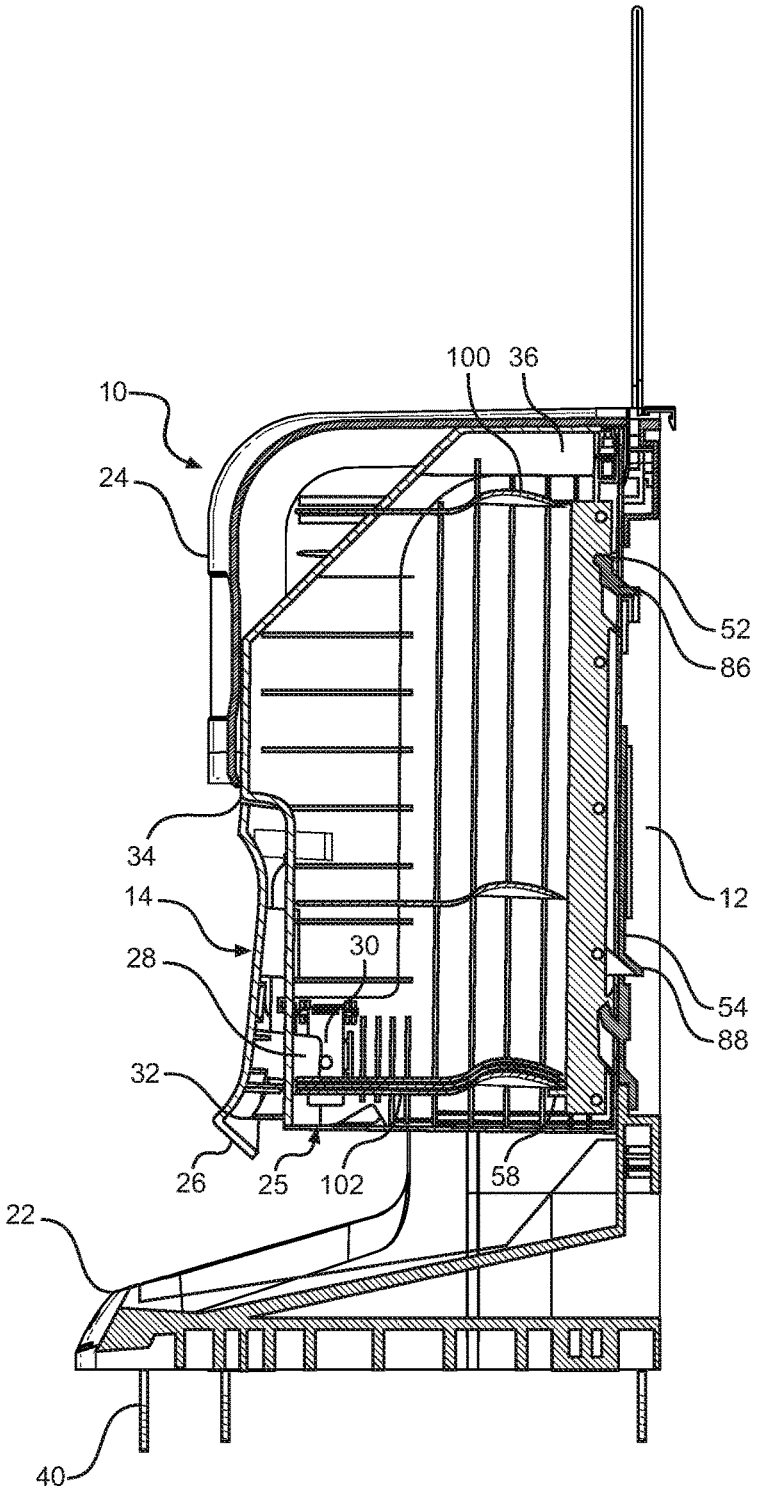
FIG. 4 is a view in side elevation of the utensil dispenser.
Figure 5:
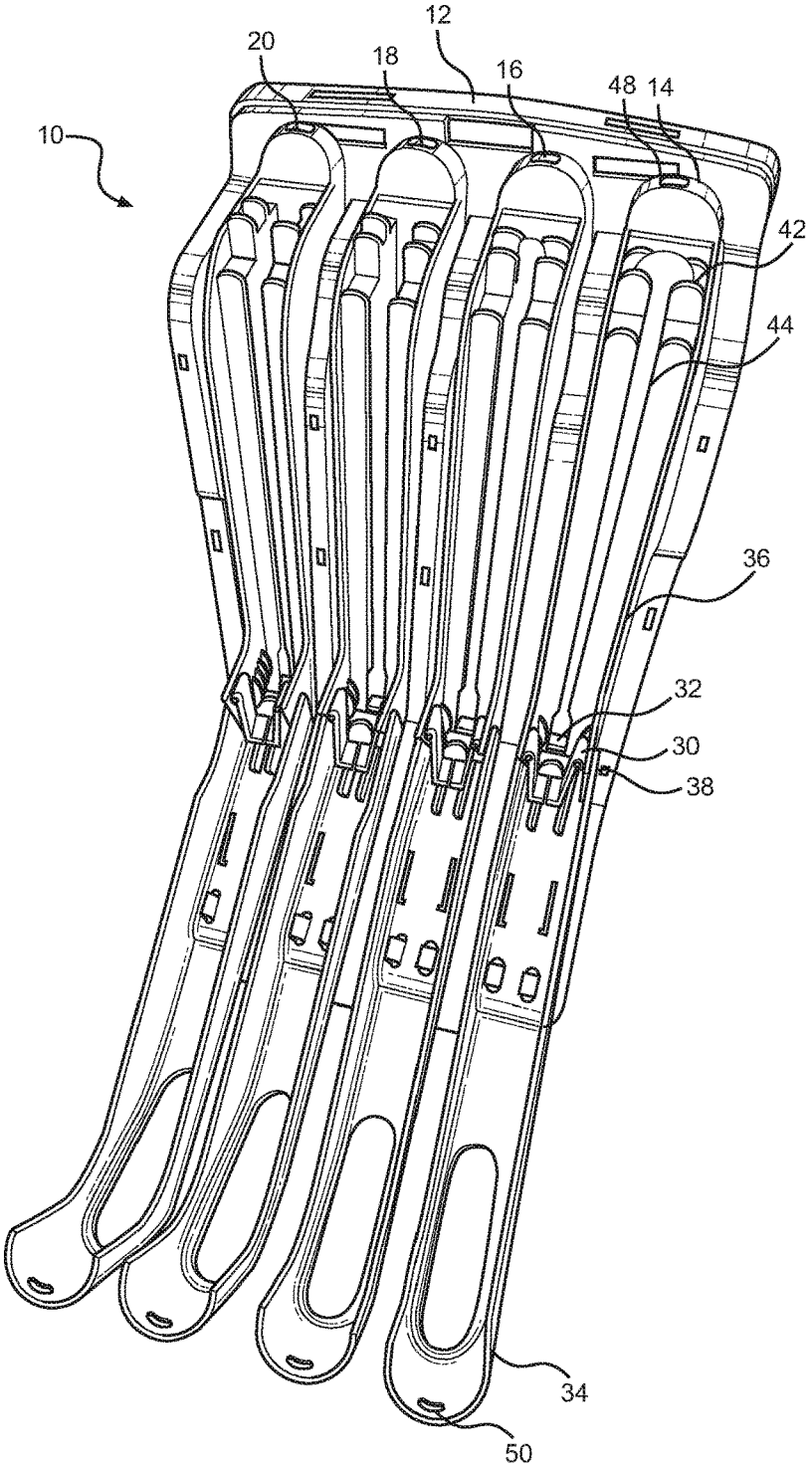
FIG. 5 is a perspective view of the utensil dispenser with the utensil chamber covers of the utensil chambers in an open configuration.
Figure 17:
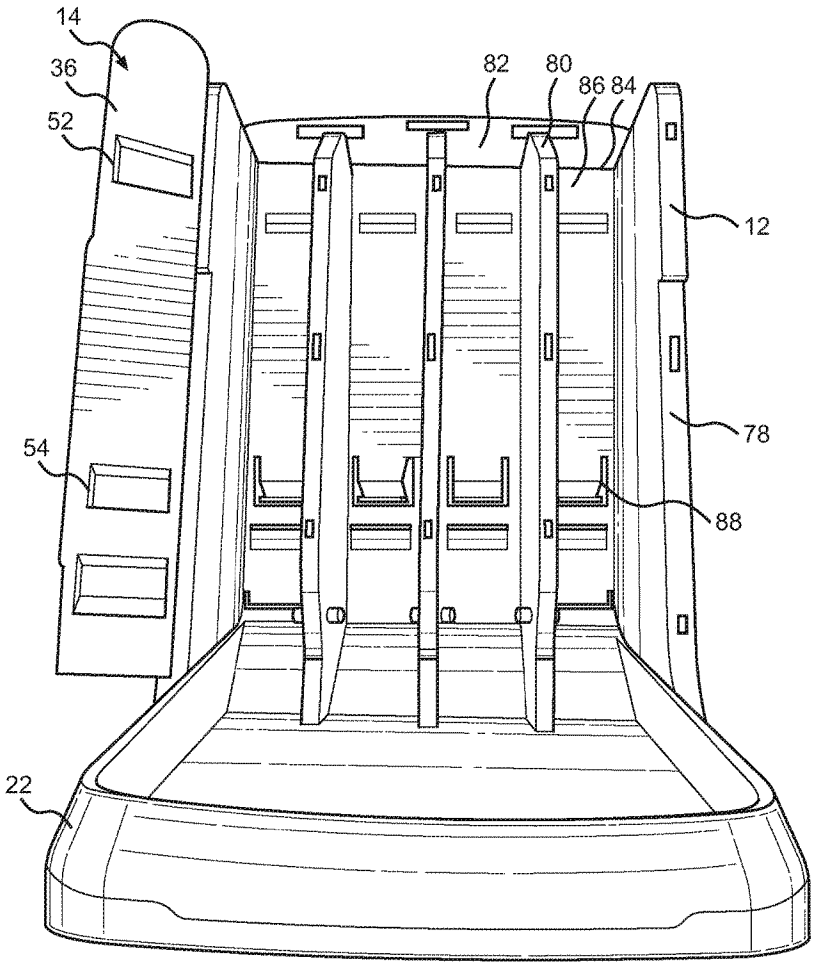
FIG. 17 is a view of the main housing of the utensil dispenser depicted in front elevation and a utensil chamber disposed in rear elevation, in cooperation illustrative of the mechanism for retaining the utensil chambers relative to the main housing.

With additional reference to FIGS. 4 and 17, for example, the dispensing chambers 14, 16, 18, and 20 can be understood to be removable and replaceable in relation to the main housing 12. With that, the types of utensils to be retained and dispensed can be varied depending, for instance, on expected usage and other factors. As shown in FIG. 17, the main housing 12 has a rear wall 82, first and second sidewalls 78, and a plurality of interposed dividing walls 80 that cooperate to define a plurality of utensil chamber bays 84, each for receiving and retaining a utensil chamber 14, 16, 18, or 20.

As is shown relative to the first utensil chamber 14 in FIG. 17, the utensil chambers 14, 16, 18, and 20 and the main housing 12 have selective retention mechanisms to permit the chambers 14, 16, 18, and 20 to be selectively locked in place relative to the main housing 12. More particularly, as FIGS. 4 and 17 illustrate, each utensil chamber bay 84 in this example has upper and lower hook structures 86 that extend from the rear wall 82, and each utensil chamber 14, 16, 18, and 20 has correspondingly sized and positioned upper and lower support notches 52 in the utensil chamber body 36 for removably receiving the corresponding hook structure 86 thereby to support the utensil chamber 14, 16, 18, or 20 in relation to the main housing 12. Further, each utensil chamber 14, 16, 18, and 20 has a latching notch 54 while each utensil chamber bay 84 has a correspondingly located locking latch 88 that engages the latching notch 54 in a snap-fit, locking engagement. When the latching notch 54 and the locking latch 88 are engaged, the respective utensil chamber 14, 16, 18, or 20 is locked in place. When it is desired to remove the utensil chamber 14, 16, 18, or 20 from the main housing 12, the latch 88 can be disengaged from the latching notch 54, such as by pulling on the latch 88.

With particular reference to FIGS. 3 through 6, each utensil chamber 14, 16, 18, and 20 can be perceived to have a utensil chamber body 36. A utensil chamber cover 34 selectively engages the utensil chamber body 36. In this example, the engagement is by a pivotal coupling of the utensil chamber cover 34 to pivot about a pivot axis 38 in relation to the utensil chamber body 36. The utensil chamber cover 34 has a closed condition, as in FIGS. 3 and 4, wherein the utensil chamber cover 34 cooperates with the utensil chamber body 36 to substantially encase the inner volume of the utensil chamber 14, 16, 18, or 20 and an open condition, as in FIGS. 5 and 6, wherein the utensil chamber cover 34 is pivoted away from the utensil chamber body 36 to permit access to the inner volume of the utensil chamber 14, 16, 18, or 20.

Figure 7:
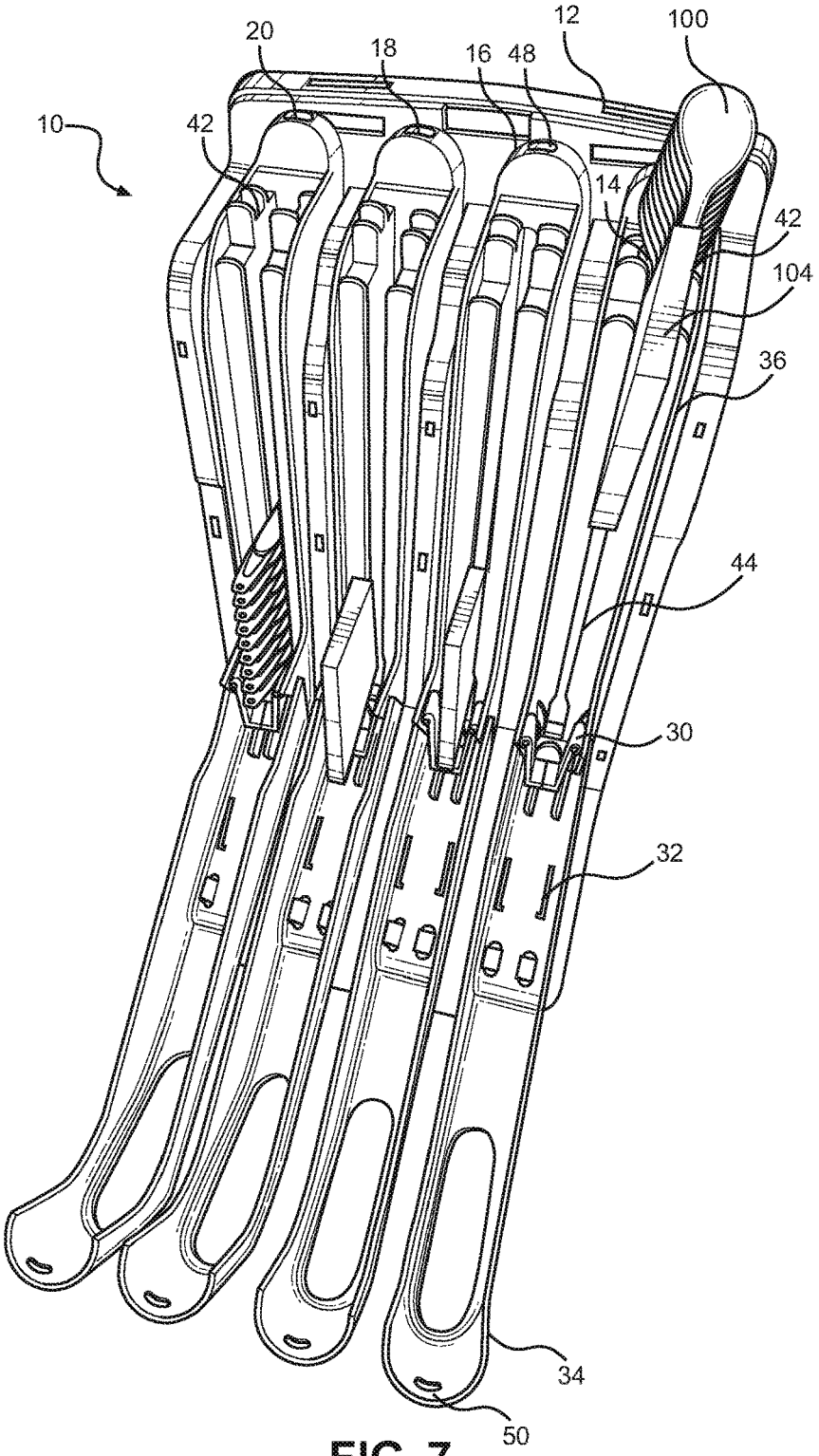
FIG. 7 is a perspective view of the utensil dispenser with the utensil chambers open and with stacks of utensils in different stages of loading into the utensil chambers.
Figure 8:
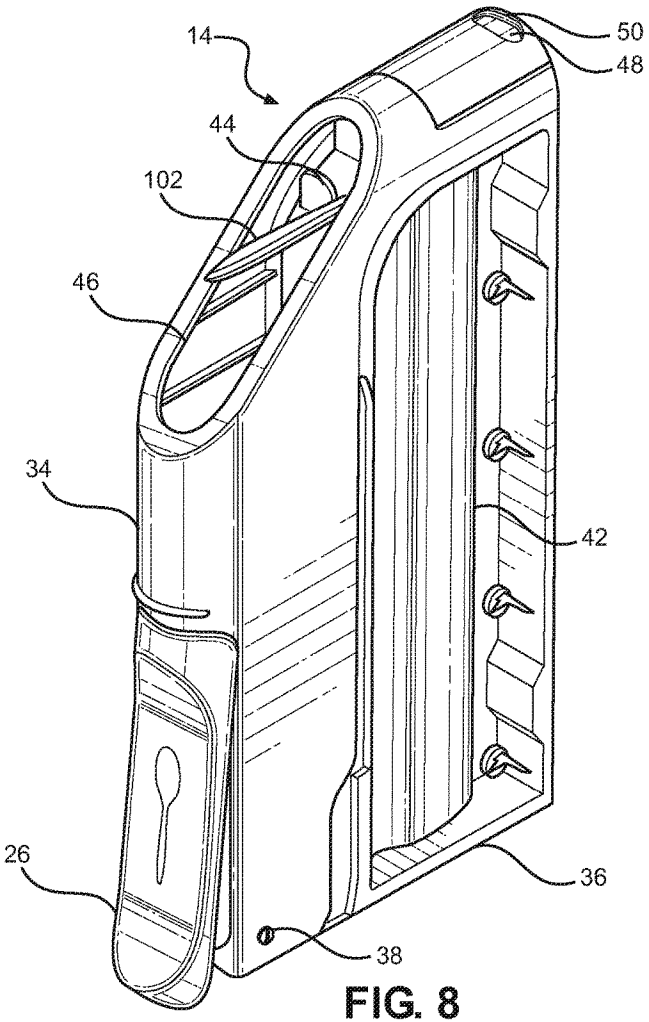
FIG. 8 is a perspective view of a utensil chamber as disclosed herein.

As can be understood with additional reference to FIG. 8, each utensil chamber 14, 16, 18, and 20 has a release button 48 in an upper portion thereof that cooperates with an aperture 50 to selectively retain the utensil chamber cover 34 in the closed condition. In the depicted embodiment, the release button 48 is resiliently retained in relation to the utensil chamber body 36, and the aperture 50 is correspondingly shaped and located in the utensil chamber cover 34. With that, when the release button 48 is not depressed, it enters the aperture 50 in the utensil chamber cover 34 to lock the cover 34 in a closed condition as in FIG. 8. When the release button 48 is depressed, it releases the utensil chamber cover 34 to permit the cover 34 to be pivoted to an open condition as in FIG. 7.

Figure 6:
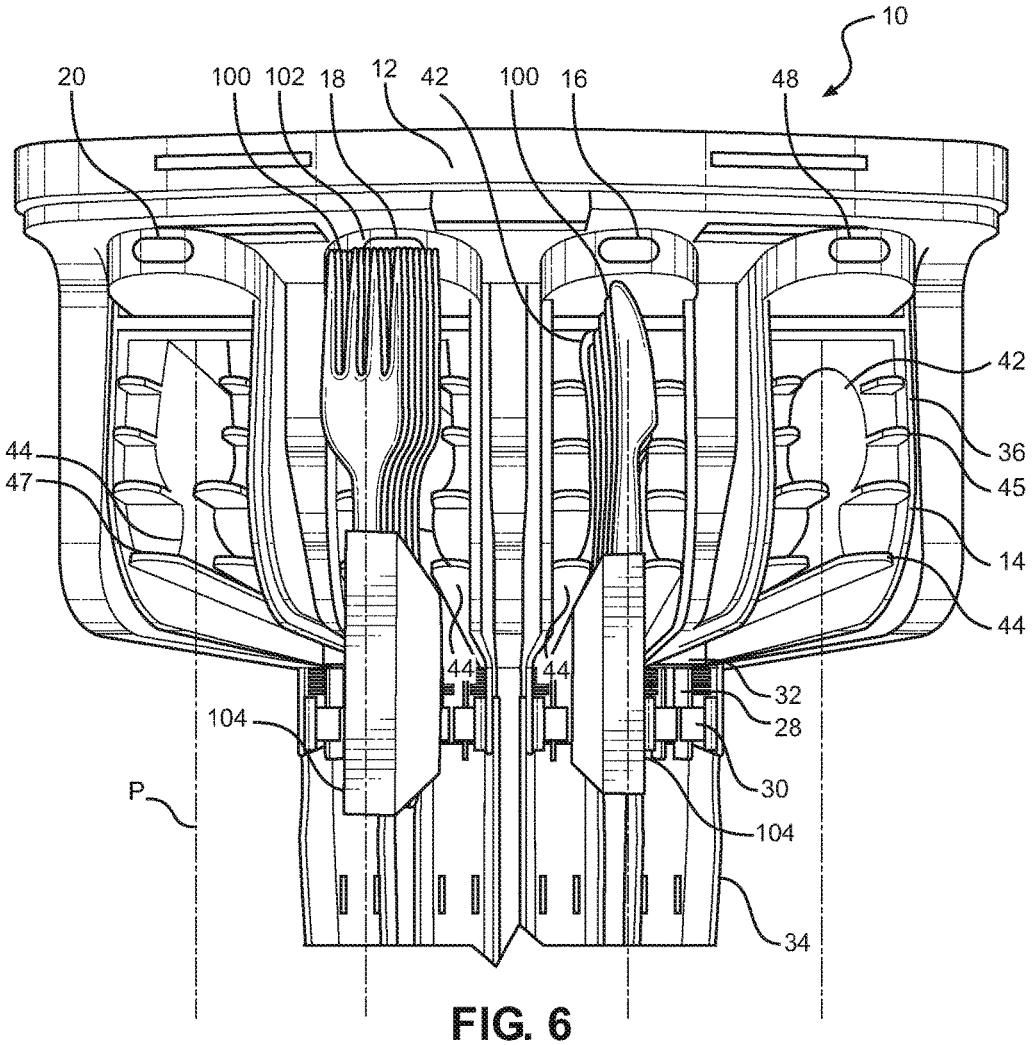
FIG. 6 is a top plan view of the utensil dispenser with the utensil chamber covers open and with stacks of utensils being loaded into the utensil chambers.

The utensil chamber body 36 of each utensil chamber 14, 16, 18, and 20 defines a utensil channel 42. The utensil channel 42 communicates through the utensil chamber body 36 from a first or upper end of the utensil chamber body 36 and the utensil channel 42 to a second or lower end of the utensil chamber body 36 and the utensil channel 42. The second or lower end of the utensil channel 42 comprises a dispensing end, which may alternatively be referred to as a dispensing portion. As can be perceived with reference to FIG. 6, for instance, the utensil channels 42 defined by the utensil chamber body 36 have a lateral cross-sectional shape and size corresponding to the peripheral shape of the working end of the utensils to be retained and dispensed with tolerance to permit a utensil stack 100 to be slidably received into the channel 42. In the configuration of FIG. 6, for instance, the utensil channel 42 of the utensil chamber 14 has a utensil channel 42 with a peripheral shape of a working end of a soup spoon while the utensil channel 42 of the utensil chamber 16 has the peripheral shape of a working end of a knife and the utensil channels 42 of the chambers 18 and 20 have the peripheral shapes of the working ends of forks. The utensil channels 42 have longitudinal ribs 45 spaced around their respective peripheries to limit friction and to prevent jamming of utensils within the utensil stack 100 as the utensils are loaded and dispensed from the utensil chamber 14, 16, 18, and 20. In the embodiment of FIG. 6, for instance, the utensil channels 42 have first and second ribs 45 communicating longitudinally along each of the sides of the utensil channel 42.

Each utensil chamber 14, 16 18, and 20 has a longitudinal slot 44 in the chamber body 36 that is contiguous with the utensil channel 42. The longitudinal slot 44 communicates from the first or upper end of the utensil chamber body 36 to the second or lower end of the utensil chamber body 36. The longitudinal slot 44 is centrally aligned and contiguous with the peripheral shape of the working portion of the utensil to be retained and dispensed Like the utensil channels 42, the longitudinal slots 44 have longitudinal ribs 47 communicating longitudinally along each of the sides of each slot 44 to limit friction and prevent jamming of utensils within a utensil stack 100.

Under the foregoing construction, utensils 102 and stacks 100 of utensils 102 can be loaded into the respective utensil chambers 14, 16, 18, and 20 with the working ends of the utensils 102 stacked, such as face down where applicable, within the utensil channels 42, with the shanks of the utensils 102 disposed through the longitudinal slots 44, and with the handles of the utensils 102 projecting anteriorly through the slots 44.

As disclosed herein, utensils 102 are retained in stacks 100 pending loading into the utensil chambers 14, 16, 18, or 20. The stacks 100 are maintained by a reception and retention of the handles of the stacked utensils 102 in sleeves 104, such as recyclable cardboard sleeves 104. The sleeves 104 comprise rectangular boxes with five walls, namely first and second sidewalls, top and bottom walls, and an end wall. The end of the sleeve 104 opposite the end wall is open to receive the handle portions of the utensils 102. The sleeves 104 can be considered to have a depth corresponding to the distance from the open end to the opposite end wall and equivalent to the length of the sidewalls. The depth of the sleeves 104 also corresponds approximately to the length of the portions of the handles of the utensils 102 that project beyond the slots 44. The sleeves 104 have a height sufficient to permit several utensils 102 to be stacked atop one another to create a stack 100 with the handles of the utensils 102 snugly but removably retained within the sleeve 104.

The handles of the utensils 102 are retained in the sleeves 104 in an organized, stacked manner by the lateral support provided by the sidewalls and the compressive force provided by the top and bottom walls and the mutual frictional and mechanical engagement between the utensils 102 themselves and between the utensils 102 and the sleeves 104. When the utensils 102 are stacked in sufficient number within the sleeve 104 in an aligned format, they are removably but effectively retained in the sleeve 104 pending installation in the utensil channel 42 without the use of adhesive or any other fastening or locking mechanism. The number of utensils 102 forming a stack 100 of utensils 102 within each sleeve 104 may vary within the scope of the invention.

With the utensil dispenser 10 and the stacks 100 of utensils 102 so configured, the utensil dispenser 10 can be quickly and conveniently loaded as is illustrated in FIGS. 6 and 7, for instance. In a typical loading process, the lid 24 would be removed or pivoted to an open condition relative to the main housing 12. Then, the utensil chamber cover 34 of the utensil chamber or chambers 14, 16, 18, and 20 to be loaded with utensils 102 can be opened by a depressing of the release button 48 to disengage the button 48 from the aperture 50 to permit the cover 34 to be pivoted about the pivot axis 38 relative to the utensil chamber body 36 from the closed condition of FIG. 8, for example, to the open condition of FIGS. 6 and 7, for example. With that, the utensil channels 42 and the slots 44, including the open upper ends thereof, are exposed for access.

With the utensil channels 42 and the slots 44 exposed, the installer can grip a stack 100 of utensils 102 within a utensil sleeve 104, such as by a squeezing the sides of the sleeve 104. Where the utensils 102 are maintained in a stack 100 within a sleeve 104, the entire stack 100 of utensils 102 can be retrieved, loaded, and otherwise handled by a grasping of the sleeve 104 with little or no need for any direct contact by the installer with the working ends or any other portion of the utensils 102 themselves. To the extent it might be necessary in view of the unrestrained engagement between and among the utensils 102 and the sleeve 104, the gripping of the sides of the sleeve 104 tends to induce the stacked utensils 102 to an automatically aligned condition as the sidewalls of the utensil sleeve 104 press on the sides of the several utensils 102.

With the stack 100 of utensils 102 gripped by the utensil sleeve 104, the working portions of the utensils 102 can be aligned with the peripheral utensil shape of the respective utensil channel 42 and slot 44. While gripping the sleeve 104, the stack 100 of utensils 102 can be lowered into the utensil channel 42 and the slot 44 with the handles of the utensils 102 projecting anteriorly through the slot 44 while still encased in the sleeve 104. The stack 100 of utensils 102 can, for instance, be lowered until the lowermost utensil 102 of the stack 100 is in proximity to the lower ends of the utensil channel 42 and the slot 44 or, where applicable, in proximity to a previously installed utensil 102 or stack of utensils 102. Further stacks 100 of utensils 102 can in a similar manner be loaded above previously installed utensils 102 or stacks 100 of utensils 102. When the stack 100 or stacks 100 of utensils 102 is or are fully loaded, the installer can simply slide the sleeve 104 off of the handles of the several retained utensils 102 thereby yielding a combined stack 100 of utensils 102 aligned with the longitudinals of the utensil channel 42 and the slot 44 and aligned with a longitudinal, central plane P of the utensil channel 42 and the slot 44 as can be perceived in FIG. 6, for instance. In one practice of the invention, which is of course not limiting, each utensil channel 42 has the capacity to receive and retain approximately 115 utensils 102 for dispensing. With the utensils 102 stacked in the utensil channel 42 and the sleeves 104 removed, the utensil chamber cover 34 of the utensil chamber or chambers 14, 16, 18, and 20 can be closed by pivoting the cover 34 about the pivot axis 38 relative to the utensil chamber body 36 until the release button 48 engages the aperture 50 thereby locking the utensil chamber cover 34 in the closed position of, for example, FIG. 8 ready to dispense utensils. The hood 24 can then be reaffixed to the main housing 12 so that the retained utensils 102 cannot be accessed except through dispensing actuation as taught herein.

When the stack 100 of utensils 102 is fully disposed in the utensil channel 42 and the utensil dispenser 10 is disposed in an upright orientation with the longitudinals and the central planes P of the utensil channels 42 disposed generally vertically, the utensils 102 within the stacks of utensils 102 will be retained in a face-down, substantially horizontal disposition. The lowermost utensil 102' of the stack 100 of utensils 102 is disposed adjacent to the lower end of the utensil channel body 36 and is supported in a first support location by a first support structure 30 and in a second support location spaced from the first support location by a second support structure 58. In the depicted embodiment, the first support structure 30 supports the lowermost utensil 102' adjacent to the proximal portion of the handle of the utensil 102' while the second support structure 58 supports the tip portion of the working end of the lowermost utensil 102'. The entire stack 100 of utensils 102 is supported vertically through the support of the lowermost utensil 102' by the support structures 30 and 58.

Figure 9:
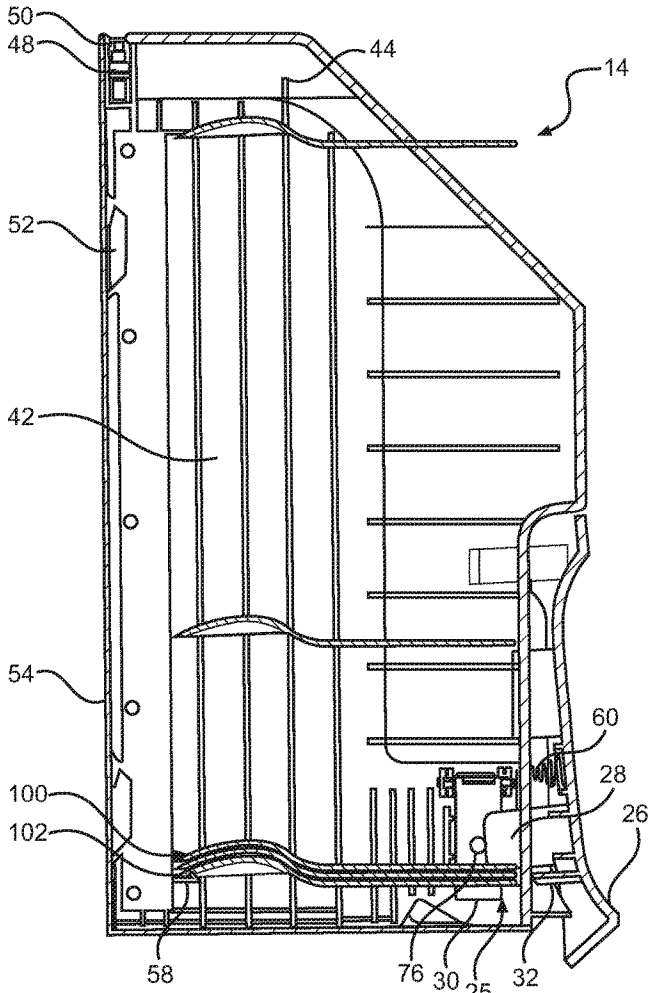
FIG. 9 is a cross-sectional view of the utensil chamber.

As shown in FIGS. 4 and 9, for instance, the second support structure 58 in the depicted embodiment of the utensil dispenser 10 comprises a fixed support structure 58, which can alternatively be characterized as a lip or shelf 58. The support structure 58 in certain embodiments is downwardly sloped toward the utensil channel 42 as shown, for instance, in FIG. 11.

The first support structure 30, however, comprises a movable support structure 30 with a first condition wherein the first support structure 30 is disposed in a support position below the lowermost utensil 102', particularly the handle portion of the lowermost utensil 102' and vertical support is provided to the handle portion of the lowermost utensil 102'. The first support structure 30 further has a second condition wherein the first support structure 30 is moved out of the support position below the lowermost utensil 102' so that the handle portion of the lowermost utensil 102' is not provided with vertical support.

Figure 11:
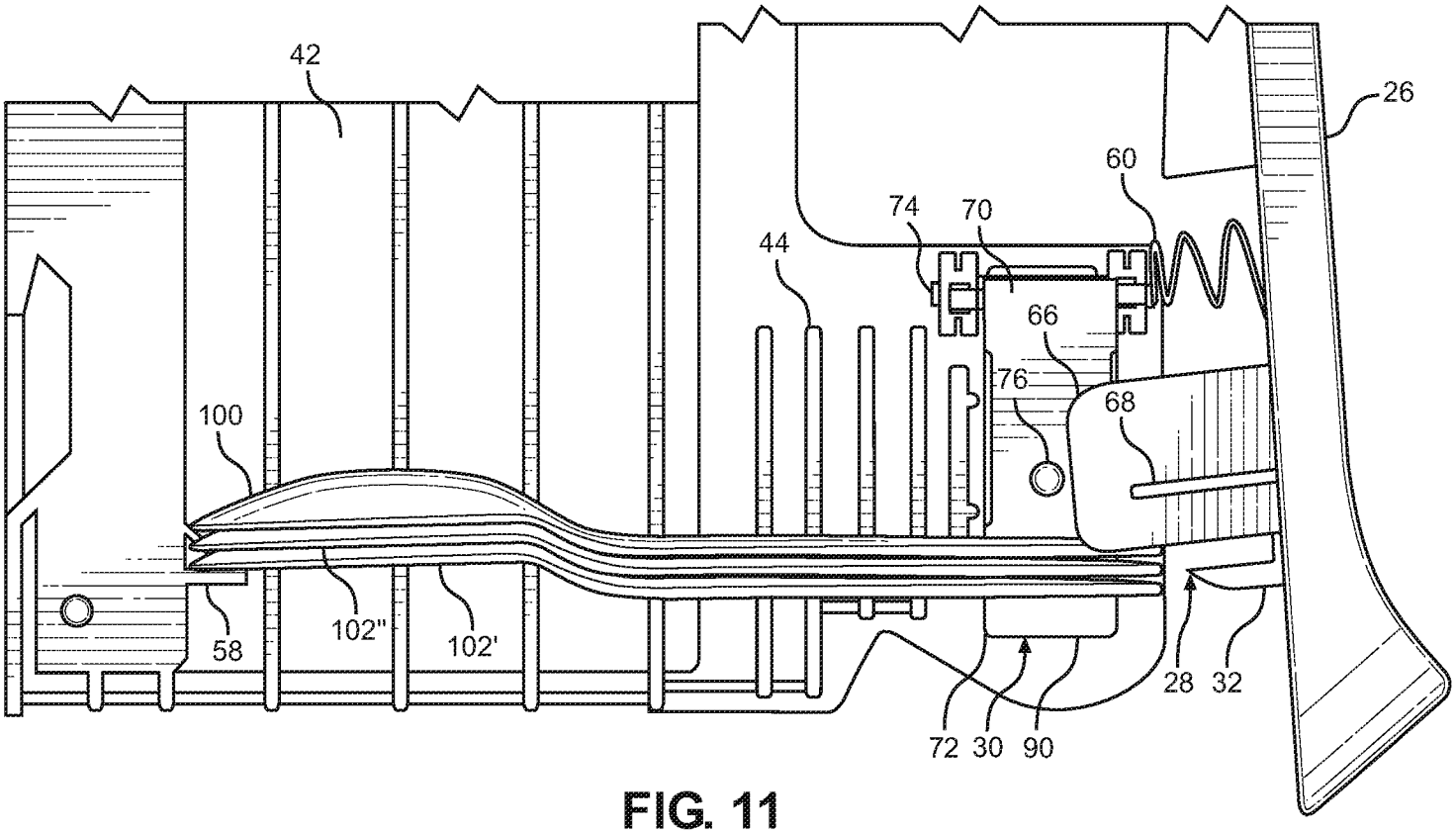
FIG. 11 is a cross-sectional view in side elevation of components of the actuating portion of the utensil dispenser.
Figure 16:
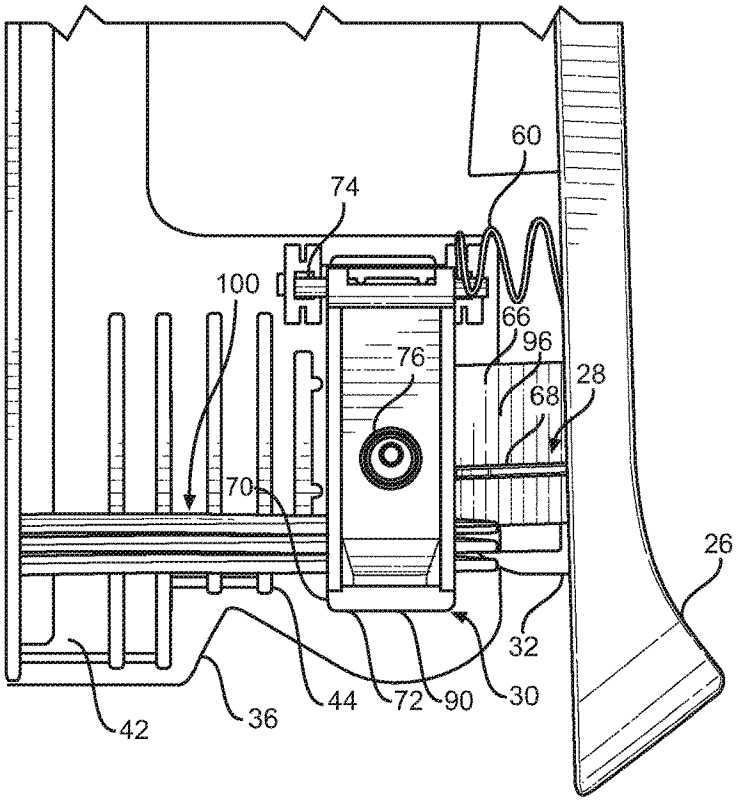
FIG. 16 is a sectioned view in side elevation of the components of the actuating portion of the utensil dispenser of FIG. 15 during adjustment to a utensil-dispensing configuration.
Figure 15:
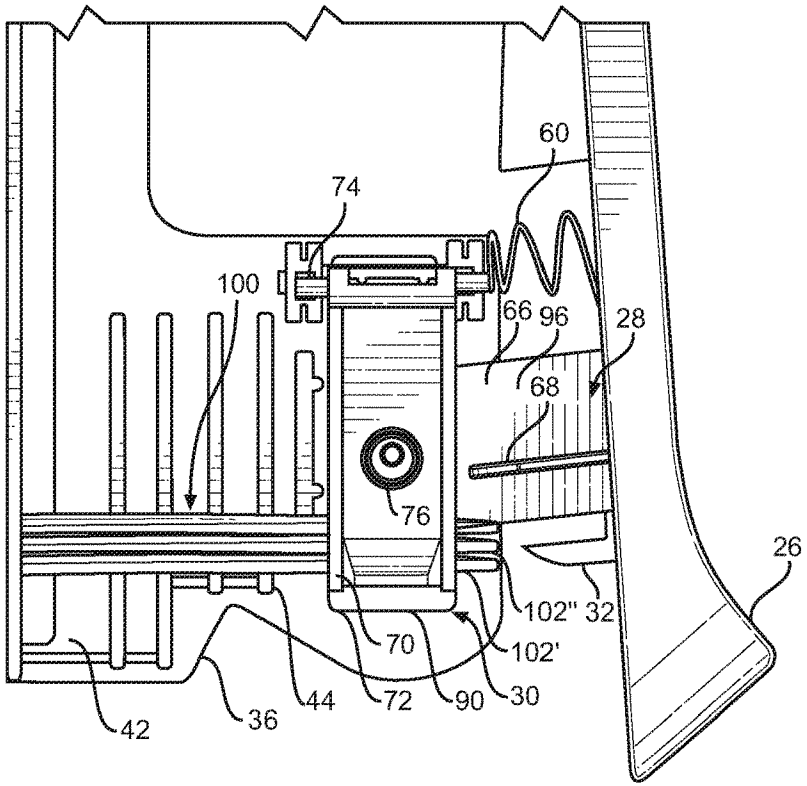
FIG. 15 is a sectioned view in side elevation of components of the actuating portion of the utensil dispenser in a utensil-supporting configuration.

As will be described further hereinbelow, including with respect to FIGS. 11, 15, and 16, an intervening, actuated support structure 32 is movable from a first position wherein the actuated support structure 32 is physically clear of the stack 100 of utensils 102 and does not support the stack 100 of utensils 102 to a second position wherein the actuated support structure 32 is interposed between the lowermost utensil 102' and the second lowermost utensil 102" to provide support to the remaining stack 100 of utensils 102 above the lowermost utensil 102' by direct support of the second lowermost utensil 102". When in the second position, the actuated support structure 32 in this embodiment supports the proximal end of the handle of the second lowermost utensil 102".

When the first support structure 30 is disposed in the second condition and the actuated support structure 32 is in the second position, the handle portion of the lowermost utensil 102' is not provided with support while the tip of the working end of the lowermost utensil 102' is supported by the fixed support structure 58. Further, the handle portion of the second lowermost utensil 102" is provided with support by the actuated support structure 32. Also, the working end of the second lowermost utensil 102" is supported through the support of the fixed support structure 58 provided to the working end of the lowermost utensil 102'

The positions of the movable support structure 30 and the actuated support structure 32 are interdependent. When the actuated support structure 32 is in the first position, the movable support structure 30 is in the first condition. When the actuated support structure 32 is in the second position, the movable support structure 30 is in the second condition. Under the foregoing conditions, with the lowermost utensil 102' supported only at the tip of the working end by the fixed support structure 58, the handle portion of the lowermost utensil 102' will tend to fall under the force of gravity thereby causing the lowermost utensil 102' to pivot about the support provided by the fixed support structure 58 at the tip of the working end of the lowermost utensil 102' and, eventually, out of engagement with the fixed support structure 58. With that, while the previously second lowermost utensil 102" and the remainder of the stack 100 of utensils 102 will remain supported, the lowermost utensil 102' will be permitted to separate entirely from the stack 100 of utensils 102 and to fall, such as onto the dispensing tray 22, to be retrieved by the user.

In embodiments of the utensil dispenser 10 as disclosed herein, the adjustments of the positions of the movable support structure 30 and the actuated support structure 32 are simultaneously induced by an actuator 26, which in the depicted example is a manual actuator 26. Where it is manually operable, the actuator 26 can, for instance, be pressed to an actuated condition. When the actuator 26 is in the actuated condition, the movable support structure 30 is induced to the second condition in which the first or movable support structure 30 is moved out of the support position below the lowermost utensil 102' so that the handle portion of the lowermost utensil 102' is not provided with vertical support. The manual actuator 26 operates to move an actuation structure 28 into and out of engagement with the movable support structure 30 to reposition the movable support structure 30 from the first condition when the manual actuator 26 is not actuated to the second condition when the manual actuator 26 is actuated. Simultaneously, the actuated support structure 32 is triggered to the second position to be interposed between the lowermost utensil 102' and the second lowermost utensil 102', specifically between the proximal ends of the handle portions of the lowermost utensil 102' and the second lowermost utensil 102" to provide support to the stack 100 of utensils 102 by direct support of the second lowermost utensil 102", such as along the handle portion of the second lowermost utensil 102". Together, the manual actuator 26, the actuation structure 28, the first support structure 30, and the actuated support structure 32 form a dispensing or release mechanism 25 that permits a single utensil 102 to be dispensed reliably and efficiently from among a stack 100 of utensils 102 for each actuation of the manual actuator 26. The dispensing mechanism 25 is disposed at the dispensing end of the utensil channel 25.

Figure 10:
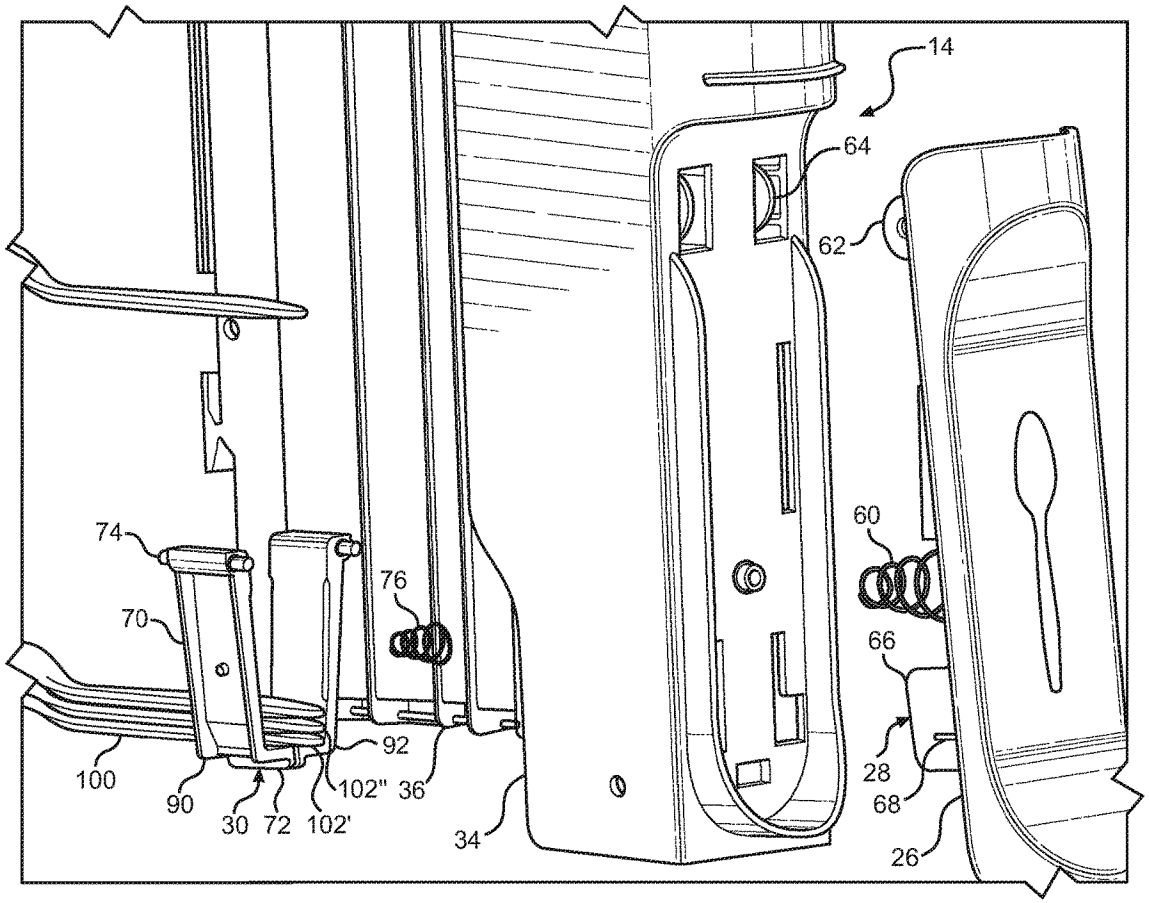
FIG. 10 is an exploded perspective view of components of the actuating portion of the utensil dispenser.

As can be perceived by reference to FIGS. 8 through 10, for instance, the actuator 26 can comprise a pivotable member with an end portion, such as an upper end portion, pivotally coupled to the utensil chamber cover 34, such as by pivot arms 62 that extend from the actuator 26 in combination with pivot receivers 62 disposed in the utensil chamber cover 34. The opposite end portion, in this case the lower end portion, of the actuator 26 is thus movable, as by pivoting, into and out of proximity with the utensil chamber cover 34 so that the actuator 26 has an actuated position when pressed into proximity with the utensil chamber cover 34 and a non-actuated position when pivoted away from the utensil chamber cover 34. The actuator 26 is biased to the non-actuated position by a resiliently compressible member 60, which in this example comprises a compression spring 60.

A particular embodiment of the release mechanism 25 can be understood with further reference to FIGS. 10 through 16. In general, as again shown in FIG. 12, the utensil chamber cover 34 and the utensil chamber body 36 can be considered to have a central plane P aligned with the longitudinal of the handle portions of the stack 100 of utensils 102 and a lateral direction generally perpendicular to the central plane P. The utensil dispenser 10 may be shown and described herein as having upper and lower, top and bottom, and similar directional relationships with the presumption that the dispenser 10 is disposed with the longitudinal of the utensil channels 42 in a generally vertical orientation as, for instance, in FIG. 1. It shall be understood that such references are to enable a better understanding of the dispenser 10 only and are not limiting regarding the structure or function of the dispenser 10.

The first, movable support structure 30 is formed by first and second arms 90 and 92 disposed in opposition and to opposite sides of the central plane P. Each arm 90 and 92 is pivotable about a pivot axis 74 that is parallel to the central plane P. Each arm 90 and 92 has a proximal portion 70 that depends from the pivot axis 74 and a distal portion 72 that is angled toward the central plane P and thus toward the distal portion 72 of the opposite arm 90 or 92. The distal portions 72 of the arms 90 and 92 can, for example, be at or nearly perpendicular to the proximal portions 70 of the arms 90 and 92.

Figure 12:
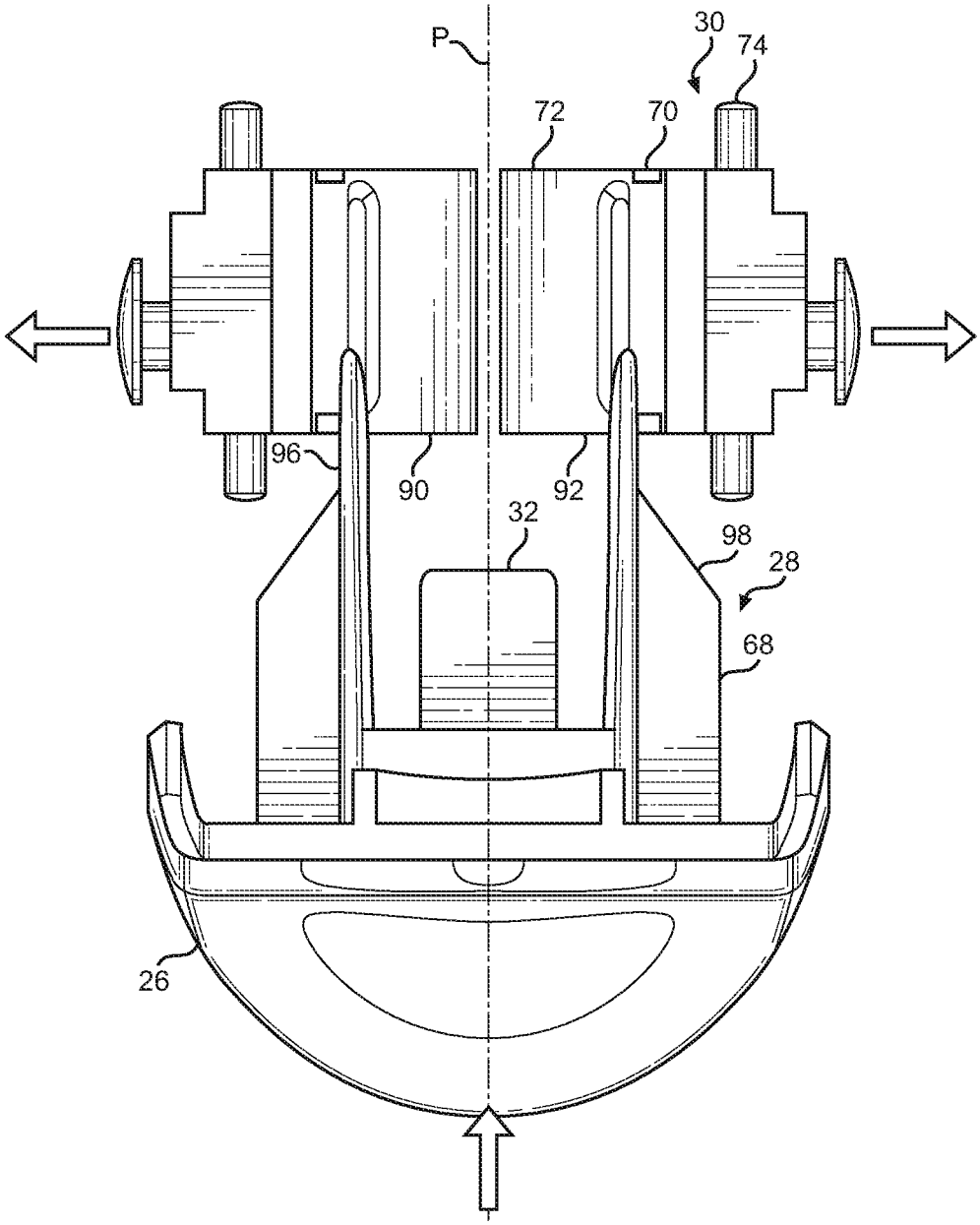
FIG. 12 is a top plan view of components of the actuating portion of the utensil dispenser.
Figure 14:
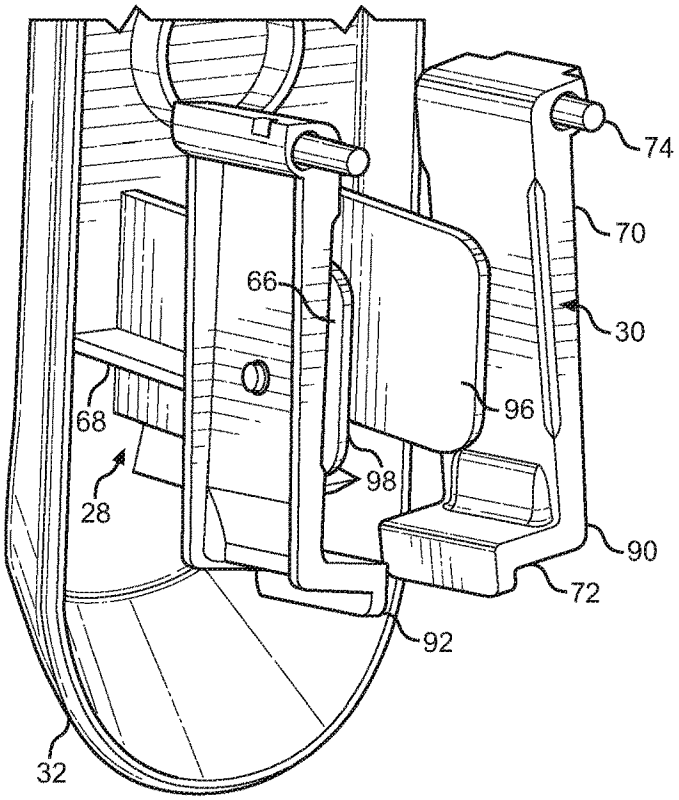
FIG. 14 is a perspective view of the components of the actuating portion of the utensil dispenser of FIG. 13 in a utensil-dispensing configuration.
Figure 13:
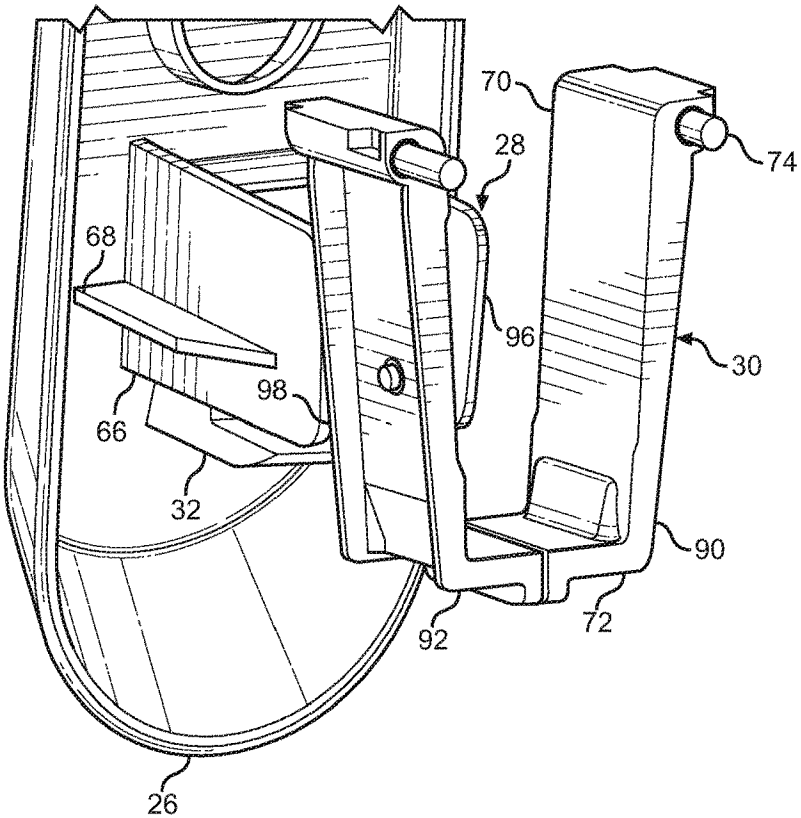
FIG. 13 is a perspective view of components of the actuating portion of the utensil dispenser in a utensil-supporting configuration.

When the movable support structure 30 is in the first condition as in FIGS. 12 and 13, for instance, the tips of the distal portions 72 of the arms 90 and 92 are in proximity to one another, separated, if at all, by a distance less than a width of the overlapping portion of the handles of the utensils 102. The distal portions 72 of the arms 90 and 92 are generally perpendicular to the central plane P whereby the distal portions 72, when in proximity to one another, present a substantially continuous, flat support surface for the handle of the lowermost utensil 102'. The proximal portions 70 of the arms 90 and 92 are disposed to be lateral to and beside the central plane P and, when loaded, the stack 100 of utensils 102. The distal portions 72 of the arms 90 and 92 are disposed below the lowermost utensil 102' of the stack 100 of utensils 102 when the movable support structure 30 is in the first condition. As shown, for example, in FIGS. 9 through 11, 15, and 16, the arms 90 and 92 are biased to the first condition supporting the stack 100 of utensils 102 by resiliently compressible members 76, such as compression springs 76. Together, the first and second arms 90 and 92 form a breakaway cradle that supports the stack 100 of utensils 102 when the arms 90 and 92 are in the first condition as in FIG. 13 and that does not support the stack 100 of utensils 102 when the arms 90 and 92 are pivoted away from one another about the pivot axes 74 as in FIG. 13 in the second condition.

The actuation structure 28 has a first actuation member 96 disposed to a first side of the central plane P that engages the proximal portion 70 of the first arm 90 and a second actuation member 98 disposed to a second side of the central plane P that engages the proximal portion 70 of the second arm 92. The actuation members 96 and 98 are fixed to project generally in parallel from the manual actuator 26 toward the respective arms 90 and 92. Each actuation member 96 and 98 is formed with a spreader member or tooth 66, that in this case takes the form of a fin 66, that is aligned to be received between the respective arm 90 and 92 and a retained stack 100 of utensils 102 generally in parallel with the central plane P.

Each actuation member 96 and 98 is further formed with a sloped, outwardly facing ramp surface 68. In this embodiment, the ramp surface 68 is formed by an angled fin 68 that progressively increases in effective distance from the central plane P from a portion of the ramp surface 68 distal to the actuator 26 to a portion of the ramp surface 68 proximal to the actuator 26. The ramp surfaces 68 increase in the effective distance between the ramp surfaces 68 from a minimum at the distal portions thereof sufficient to permit the ramp surfaces 68 to be received between the proximal portions 70 of the arms 90 and 92 to a maximum sufficiently greater than the distance between the corresponding portions of the proximal portions 70 of the arms 90 and 92 to cause the tips of the distal portions 72 of the arms 90 and 92 to be separated by more than the width of the handles of the utensils 102 to be dispensed. By way of a non-limiting, illustrative example, where the utensils 102 have handles with a maximum width of approximately one-half inch, the ramp surfaces 68 can increase in effective distance between them to a maximum sufficiently greater than the distance between the corresponding portions of the proximal portions 70 of the arms 90 and 92 to cause the tips of the distal portions 72 of the arms 90 and 92 to be separated by more than one-half inch, such as approximately 9/16 inch, when the actuator 26 is fully depressed.

It will be understood that other configurations of the ramp surfaces 68 are possible. By way of example and not limitation, the ramp surfaces 68 could be formed as flat slopes rather than angled fins. It would also be possible to have the actuation members 96 and 98 with spreader members 66 that are themselves disposed with increasing distances between the outwardly facing surfaces thereof, such as by being disposed at angles in relation to the arms 90 and 92 and the central plane P so that the outwardly facing surfaces of the fins 66 themselves would form the ramp surfaces 68.

The structure and operation of the actuated support structure 32 can be further understood with reference to FIGS. 9 through 16. The actuated support structure 32 fixedly projects from the actuator 26 toward the utensil chamber body 36 centered between the actuation members 96 and 98 and centered with respect to the central plane P. The actuated support structure 32 comprises a generally rectangular member and presents a flat upper surface and a lower surface that is sloped so that the actuated support structure 32 increases in thickness with respect to the central plane P from the distal end of the actuated support structure 32. The actuated support structure 32 thus effectively forms a shelf. The proximal ends of the handles of the utensils 102 are separated by a separation distance, and the distal portion of the actuated support structure 32 narrows in the direction of the central plane P to a thickness at the distal tip of the actuated support structure 32 less than the separation distance between the proximal ends of the handles of the utensils 102.

The tip of the actuated support structure 32 is aligned with respect to the upper surfaces of the distal portions 72 of the arms 90 and 92 so that the tip of the actuated support structure 32 is disposed above the upper surfaces of the distal portions 72 of the arms 90 and 92 by the thickness of the handle portion of one of the utensils 102 plus approximately one-half of the separation distance between the proximal ends of the handles of the utensils 102. With that, on actuation, the tip of the actuated support structure 32 will be received endwise and in a direction aligned with a longitudinal of the utensils 102 between the proximal end of the handle of the lowermost utensil 102' and the proximal end of the handle of the second lowermost utensil 102" when the stack 100 of utensils 102 is fully installed as in FIGS. 15 and 16. The actuated support structure 32 projects from the actuator 26 by a distance sufficient to cause the tip of the actuated support structure 32 to be received between the handle of the lowermost utensil 102' and the handle of the second lowermost utensil 102" before the distance between the ramp surfaces 68 of the actuation members 96 and 98 separates the tips of the distal portions 72 of the arms 90 and 92 by a distance greater than the width of the handles of the utensils 102.

Under this construction, utensils 102 can be individually dispensed from the respective utensil chambers 14, 16, 18, and 20 quickly and efficiently by a simple pressing of the actuator 26. With a stack 100 of utensils 102 disposed in the utensil channel 42 with the handles thereof projecting through the slot 44 as, for example, in FIGS. 11, 15, and 16, the tip of the working portion of the lowermost utensil 102' will be supported by the sloped shelf forming the fixed support structure 58, and the handle portion of the lowermost utensil 102' will be cradled by the arms 90 and 92 with the lower surface of the lowermost utensil 102' supported by the substantially continuous surface presented by the distal portions 72 of the arms 90 and 92 in the first condition of the movable support structure 30 as in FIG. 13. The second lowermost utensil 102" and the remainder of the utensils 102 forming the stack 100 of utensils 102 above the second lowermost utensil 102" are supported by the lowermost utensil 102' in this condition.

When a utensil 102 is to be dispensed, a user can press on the actuator 26, which will pivot toward the stack 100 of utensils 102 against the biasing force of the spring 60. As the actuator 26 is depressed, the distal tip of the actuated support structure 32 will enter the space between the proximal end of the handle of the lowermost utensil 102' and the proximal end of the handle of the second lowermost utensil 102" in alignment with longitudinals of the utensils 102' and 102". With that, the actuated support structure 32, with a generally flat upper surface, will act as a temporary shelf to support the handle of the second lowermost utensil 102" and, derivatively, the handles of the remainder of the stack 100 of utensils. As the actuator 26 is further depressed, the spreader members 66 will further enter the laterally disposed spaces between the proximal portions 70 of the arms 90 and 92 and the handles of the utensils 102. Further pressing of the actuator 26 causes the outwardly-facing ramp surfaces 68 of the actuation structure 28 to press the arms 90 and 92 progressively apart until the distance between the tips of the distal portions 72 of the arms 90 and 92 exceeds the width of the corresponding portion of the handles of the utensils 102. A trap door effect is thus created as the handle portion of the lowermost utensil 102' is deprived of vertical support. Under the force of gravity, the handle portion of the lowermost utensil 102' will tend to fall, and the lowermost utensil 102' will pivot on the fixed support of the support structure 58 about the tip of the working end of the lowermost utensil 102' until disengaging therefrom whereupon the previously lowermost utensil 102' will fall, such as into the tray 22, to be retrieved by the consumer.

The actuator 26 is then permitted to retract under the biasing force of the spring 60, which causes the temporary shelf provided to the previously second lowermost utensil 102" by the actuated support structure 32 to be withdrawn from its position below the proximal end of the handle of what was previously the second lowermost utensil 102" along a direction aligned with the longitudinals of the handles of the utensils 102. Simultaneously, as the ramp surfaces 68 are withdrawn, the arms 90 and 92 and particularly the distal portions 72 thereof are permitted to come together under the biasing force of the springs 76. With that, a substantially continuous support surface is again presented by the distal portions 72 of the arms 90 and 92 as the stack 100 of utensils 102 descends within the utensil channel 42 and slot 44 under the natural force of gravity, and the previously second lowermost utensil 102" now becomes the lowermost utensil 102' ready for dispensing as previously described.

Figure 18:
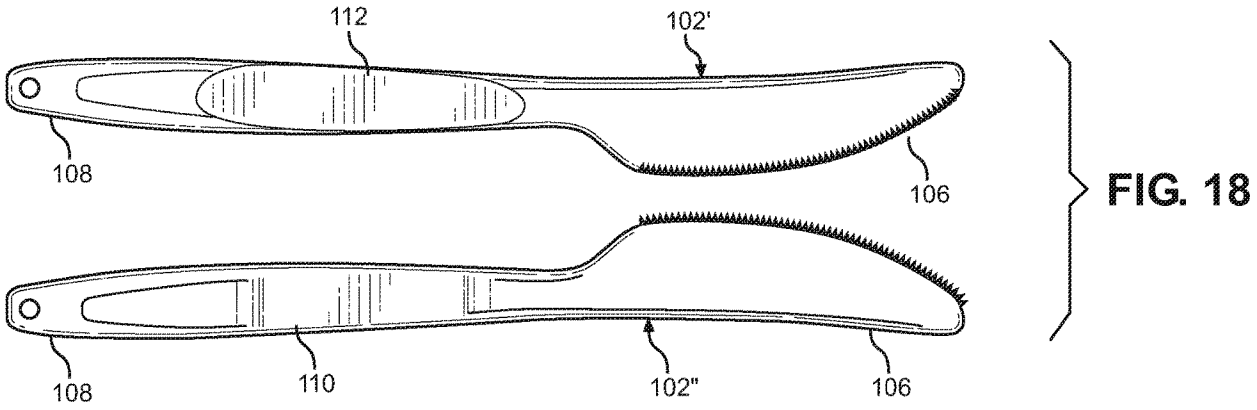
FIG. 18 is a plan view of first and second knife utensils, one in top plan and one in bottom plan, capable of being loaded and dispensed by the utensil dispenser.
Figure 19:
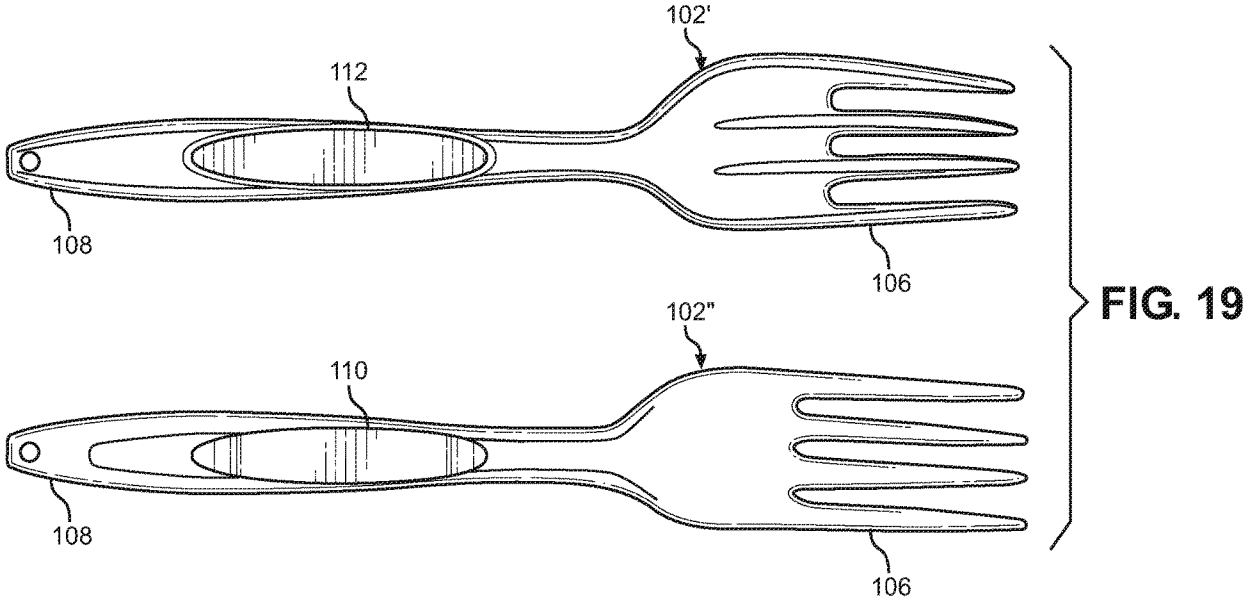
FIG. 19 is a plan view of first and second fork utensils, one in top plan and one in bottom plan, capable of being loaded and dispensed by the utensil dispenser.
Figure 20:
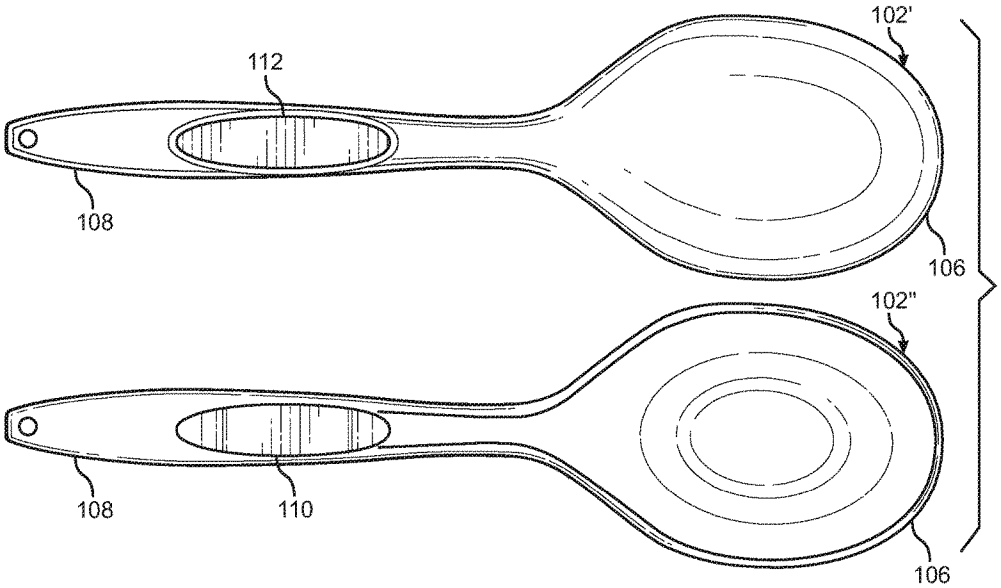
FIG. 20 is a plan view of first and second spoon utensils, one in top plan and one in bottom plan, capable of being loaded and dispensed by the utensil dispenser.

Utensils 102 need not be specially formed to be loaded and dispensed by the utensil dispenser 10 as disclosed herein. However, manifestations of the utensils 102 are contemplated wherein mutual engagement stacking formations are formed in the utensils 102 to induce a positive mechanical engagement between stacked utensils 102 and to facilitate a predetermined separation distance between the proximal ends of the handle portions of the utensils 102. Looking further to FIGS. 18 through 20, for example, first and second utensils 102' and 102" are shown each to have a working end 106 and a handle portion 108. In the case of the knives 102' and 102" of FIG. 18, the working end comprises a serrated blade. The forks 102' and 102" of FIG. 19 have working ends 106 formed with a plurality of tines while the spoons 102' and 102" of FIG. 20 have working ends 106 comprising shallow bowls. The utensils 102' and 102" can be considered to have longitudinals in line with the handle portions 108.

In each case, the handle portion 106 has an upper formation 110 disposed on what can be considered the upper surface of the utensil 102' or 102" and a lower formation 112 disposed on what can be considered the lower surface of the utensil 102' or 102". The upper formation 110 and the lower formation 112 are correspondingly disposed to engage in a mating relationship when the utensils 102' and 102" are stacked. The upper formation 110 in this embodiment comprises a protuberating, positive formation 110 and the lower formation 112 comprises an indented, negative formation 112.

Figure 21:
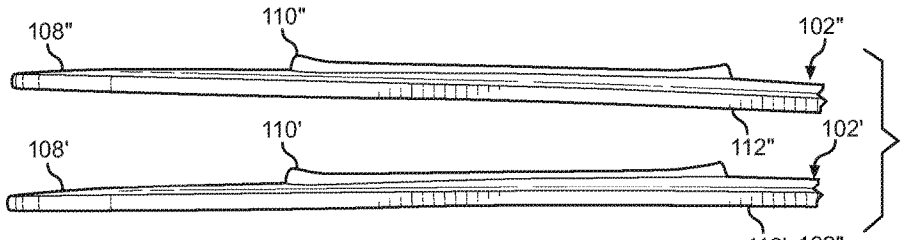
FIG. 21 is a view in side elevations of handle portions of first and second utensils in proximity for stacking.

The shapes and sizes of the formations 110 and 112 are in correspondence. In this example and as can be appreciated with further reference to FIG. 21, the upper formation 110 comprises an oblong oval formation aligned with the longitudinals of the utensils 102' and 102". The upper formation 110 has a central portion that projects at a given, central height and end portions that slope upwardly to a raised end height in relation to the surrounding surface of the utensils 102' and 102". The lower formation 112 comprises the negative of the upper formation 112 so that it has a given, central depth and end portions that deepen to deepened end depths in relation to the surrounding surface of the utensils 102' and 102". In addition to permitting the mutual engagement of the utensils 102' and 102", the formations 110 and 112 operate to enhance gripping and manipulation of the utensils 102' and 102" while also potentially contributing to its structural integrity and while permitting efficiencies in material usage.

Figure 22:
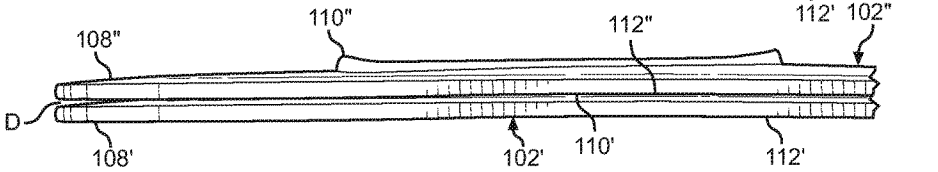
FIG. 22 is a view in side elevations of handle portions of first and second utensils engaged in a stacking configuration.

Under the foregoing construction, utensils 102 can be stacked for retention and dispensing as herein disclosed with a mutual engagement between adjacent utensils 102. For instance, and with more particular reference to FIGS. 21 and 22, an upper utensil 102" can be stacked upon a lower utensil 102' with the upper formation 110' of the lower utensil 102' received into a mating relationship with the lower formation 112" of the upper utensil 102". When stacked, the utensils 102' and 102" have a separation distance D between the proximal ends of the handles 108' and 108". In this embodiment, the separation distance D is created by a tapering of the proximal end of the handle 108 of each utensil 102, such as by having the upper surface of the proximal end of the handle 108 of each utensil 102 comprise a flat surface and the lower surface of the proximal end of the handle 108 of each utensil 102 comprise an arcuate, sloped surface that approaches the upper surface toward the most proximal end of the handle 108. The most proximal end portions of the handles 108 can be rounded. Similarly constructed utensils 102 can be stacked to form a complete stack 100 of utensils 102. As shown previously in FIG. 7, for instance, stacks 100 of utensils 102 can be retained in sleeves 104 pending installation into the respective utensil channel 42 and slot 44 for retention and dispensing with respect to the utensil dispenser 10. With the several utensils 102 so stacked, the actuated support structure 32 can be readily received between the proximal ends of the handles 108' and 108" of the lowermost utensil 102' and the second lowermost utensil 102" along the direction of the longitudinals of the utensils 102 to provide intervening, temporary support as taught herein.

With certain details and embodiments of the present invention for a utensil dispenser 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall be considered to define the scope of protection to be afforded to the inventors. Those claims shall be deemed to include equivalent constructions insofar as they do not depart from the spirit and scope of the invention. It must be further noted that a plurality of the following claims may express, or be interpreted to express, certain elements as means for performing a specific function, at times without the recital of structure or material. As the law demands, any such claims shall be construed to cover not only the corresponding structure and material expressly described in this specification but also all equivalents thereof, including those that already exist or that may hereafter be developed.

We claim as deserving the protection of Letters Patent:

1. A utensil dispenser for selectively dispensing a lowermost utensil from a stack of utensils loaded within the utensil dispenser wherein each utensil has a working end and a handle portion, the utensil dispenser comprising:

a first dispensing chamber;

a utensil channel in the first dispensing chamber adapted to receive and retain the stack of utensils wherein the utensil channel has a dispensing portion;

a dispensing mechanism selectively operable relative to the dispensing portion of the utensil channel to dispense the lowermost utensil from the stack of utensils, the dispensing mechanism comprising:

a movable support structure with a first condition wherein the movable support structure is disposed in a support position with respect to the dispensing portion of the utensil channel to support the lowermost utensil and a second condition wherein the movable support structure is moved out of the support position with respect to the dispensing portion of the utensil channel so that the movable support structure does not provide support to the lowermost utensil;

an actuated support structure with a first position wherein the actuated support structure is not disposed to support the stack of utensils to a second position wherein the actuated support structure is interposed between the lowermost utensil and a second lowermost utensil above the lowermost utensil to provide support to the stack of utensils above the lowermost utensil by direct support of the second lowermost utensil; and an actuator selectively adjustable to an actuated condition wherein the actuator is operative to induce the movable support structure from the first condition to the second condition and the actuated support structure from the first position to the second position whereby, when the actuator is in the actuated condition, the stack of utensils above the lowermost utensil is supported by the actuated support structure while the lowermost utensil is supported by neither the movable support structure nor the actuated support structure.

2. The utensil dispenser of claim 1 wherein the first dispensing chamber has a utensil chamber body and a utensil chamber cover that can be selectively engaged with the utensil chamber body and wherein the utensil channel is in the utensil chamber body.

3. The utensil dispenser of claim 1 further comprising a stack of utensils, each utensil with a working end and a handle portion, and further comprising a sleeve that removably receives the handle portions of the utensils of the stack of utensils.

4. The utensil dispenser of claim 1 further comprising a fixed support structure in a dispensing end of the utensil channel spaced from the dispensing mechanism, the fixed support structure operative to support the lowermost utensil of the stack of utensils spaced from the dispensing mechanism.

5. The utensil dispenser of claim 4 wherein the fixed support structure comprises a shelf fixed in the utensil channel.

6. The utensil dispenser of claim 5 wherein the utensil channel has a shape corresponding to a peripheral shape of the working end of the utensil and wherein the utensil channel further comprises a longitudinal slot in the first dispensing chamber contiguous with the shape corresponding to the peripheral shape of the working end of the utensil in the utensil channel, the longitudinal slot for receiving the handle portions of the utensils of the stack of utensils, wherein the fixed support structure is disposed to support a tip of the working end of the utensil, and wherein the movable support structure and the actuated support structure are disposed to align with the handle portions of the utensils of the stack of utensils.

7. The utensil dispenser of claim 1 wherein the actuator comprises a manual actuator repositionable from a first condition wherein the actuator is not actuated to a second condition wherein the actuator is actuated.

8. The utensil dispenser of claim 7 further comprising an actuation structure retained to move into engagement with the movable support structure when the actuator is repositioned from the first condition to the second condition wherein the actuation structure is operable to induce the movable support structure from the first condition to the second condition when the actuator is repositioned from the first condition to the second condition.

9. The utensil dispenser of claim 8 wherein the actuated support structure is retained by the actuator to move from the first position into the second position when the actuator is repositioned from the first condition to the second condition.

10. The utensil dispenser of claim 9 wherein the actuation structure is retained by the actuator.

11. The utensil dispenser of claim 9 wherein the positions of the movable support structure and the actuated support structure are interdependent.

12. The utensil dispenser of claim 1 wherein the movable support structure comprises at least one member with a distal portion that is disposed in the support position with respect to the dispensing portion of the utensil channel to support the lowermost utensil when the movable support structure is in the first condition and that is moved out of the support position with respect to the dispensing portion of the utensil channel so that the movable support structure does not provide support to the lowermost utensil when the movable support structure is in the second condition.

13. The utensil dispenser of claim 12 wherein the utensil channel has a shape corresponding to a peripheral shape of the working end of the utensil and wherein the utensil channel further comprises a longitudinal slot in the first dispensing chamber contiguous with the shape corresponding to the peripheral shape of the working end of the utensil in the utensil channel, the longitudinal slot for receiving the handle portions of the utensils of the stack of utensils, wherein the utensil channel has a central plane substantially aligned with the handles of the utensils, wherein the movable support structure comprises first and second members disposed in opposition with respect to the central plane, wherein each of the first and second members has a distal portion, wherein the distal portions of the first and second members are disposed in proximity when the movable support structure is in the first condition, and wherein the distal portions of the first and second members are moved away from one another when the movable support structure is in the second condition.

14. The utensil dispenser of claim 13 wherein each of the first and second members comprises an arm pivotable about a pivot axis.

15. The utensil dispenser of claim 13 wherein the distal portions of the first and second members, when in proximity when the movable support structure is in the first condition, present a substantially continuous, flat support surface.

16. The utensil dispenser of claim 13 wherein the actuated support structure is retained by the actuator to move from the first position into the second position when the actuator is repositioned from the first condition to the second condition and further comprising an actuation structure retained by the actuator to move into engagement with the first and second members of the movable support structure when the actuator is repositioned from the first condition to the second condition wherein the actuation structure is operable to induce the first and second members from the first condition to the second condition when the actuator is repositioned from the first condition to the second condition.

17. The utensil dispenser of claim 16 wherein the actuation structure comprises first and second ramp surfaces that face outwardly with respect to the central plane and wherein the first and second ramp surfaces progressively increase in effective distance between the ramp surfaces.

18. The utensil dispenser of claim 17 wherein the ramp surfaces increase in effective distance between the ramp surfaces from a minimum at distal portions of the ramp surfaces sufficient to permit the ramp surfaces to be received between the first and second members to a maximum sufficiently greater than a distance between portions of the first and second members engaged by the ramps of the actuation structure to cause the tips of the distal portions to be separated.

19. The utensil dispenser of claim 17 wherein the actuated support structure is retained by the actuator to move from the first position into the second position when the actuator is repositioned from the first condition to the second condition and wherein the actuated support structure is substantially centered between the ramp surfaces.

20. The utensil dispenser of claim 19 wherein the actuated support structure increases in thickness from a distal end of the actuated support structure.

21. The utensil dispenser of claim 1 wherein the movable support structure comprises first and second members disposed in opposition, wherein each of the first and second members has a distal portion, wherein the distal portions of the first and second members are disposed in proximity when the movable support structure is in the first condition to form a substantially continuous support surface, and wherein the distal portions of the first and second members are moved away from one another when the movable support structure is in the second condition.

22. The utensil dispenser of claim 21 further comprising a stack of utensils, each utensil with a working end and a handle portion, wherein the handle portions of the utensils have proximal ends separated by a separation distance, and wherein the actuated support structure has a distal tip aligned with respect to the support surface formed by the distal portions of the first and second members to be received in the separation distance immediately above the handle portion of the lowermost utensil.

23. The utensil dispenser of claim 1 further comprising second, third, and fourth dispensing chambers and a main housing for detachably receiving and retaining the first, second, third, and fourth dispensing chambers.

24. The utensil dispenser of claim 23 wherein the main housing has a plurality of utensil chamber bays, each utensil chamber bay adapted for detachably receiving and retaining one of the dispensing chambers.

25. A utensil dispenser for selectively dispensing a lowermost utensil from a stack of utensils loaded within the utensil dispenser wherein each utensil has a working end with a distal tip and a handle portion with a proximal end, the utensil dispenser comprising:

a first dispensing chamber;

a utensil channel in the first dispensing chamber adapted to receive and retain the stack of utensils wherein the utensil channel has a dispensing portion, wherein the utensil channel has a shape corresponding to a peripheral shape of the working end of the utensil, wherein the utensil channel has a longitudinal slot contiguous with the shape corresponding to the peripheral shape of the working end of the utensil, the longitudinal slot for receiving the handle portions of the utensils of the stack of utensils;

a dispensing mechanism selectively operable relative to the dispensing portion of the utensil channel to dispense the lowermost utensil from the stack of utensils, the dispensing mechanism comprising:

a movable support structure comprising at least one movable member with a first condition wherein the at least one movable member is disposed in a support position with respect to the dispensing portion of the utensil channel to support the lowermost utensil and a second condition wherein the at least one movable member is moved out of the support position with respect to the dispensing portion of the utensil channel so that the at least one movable member does not provide support to the lowermost utensil;

an actuated support structure with a first position wherein the actuated support structure is not disposed to support the stack of utensils to a second position wherein the actuated support structure is interposed between the lowermost utensil and a second lowermost utensil above the lowermost utensil to provide support to the stack of utensils above the lowermost utensil by direct support of the second lowermost utensil;

a manual actuator selectively repositionable from a first position wherein the manual actuator is not actuated to a second, actuated position wherein the manual actuator is actuated wherein the manual actuator is operative to induce the movable support structure from the first condition to the second condition and the actuated support structure from the first position to the second position whereby, when the manual actuator is in the actuated condition, the stack of utensils above the lowermost utensil is supported by the actuated support structure while the lowermost utensil is supported by neither the movable support structure nor the actuated support structure;

an actuation structure retained by the manual actuator to move into engagement with the movable support structure when the manual actuator is repositioned from the first condition to the second condition wherein the actuation structure is operable to induce the movable support structure from the first condition to the second condition when the actuator is repositioned from the first condition to the second condition;

wherein the actuated support structure is retained by the manual actuator to move from the first position into the second position when the manual actuator is repositioned from the first condition to the second condition.

26. The utensil dispenser of claim 25 further comprising a stack of utensils, each utensil with a working end and a handle portion, and further comprising a sleeve that removably receives the handle portions of the utensils of the stack of utensils.

27. The utensil dispenser of claim 25 further comprising a fixed support structure in the dispensing portion of the utensil channel spaced from the dispensing mechanism, the fixed support structure operative to support the lowermost utensil of the stack of utensils spaced from the dispensing mechanism.

28. The utensil dispenser of claim 27 wherein the fixed support structure is disposed to support the distal tip of the working end of the lowermost utensil, and wherein the movable support structure and the actuated support structure are disposed to align with the handle portions of the utensils of the stack of utensils.

29. The utensil dispenser of claim 25 wherein the movable support structure comprises first and second members disposed in opposition, wherein each member has a distal portion, wherein the distal portions of the members are disposed in proximity when the movable support structure is in the first condition, and wherein the distal portions of the members are moved away from one another when the movable support structure is in the second condition.

30. The utensil dispenser of claim 29 wherein the distal portions of the members, when in proximity when the movable support structure is in the first condition, present a substantially continuous, flat support surface.

31. The utensil dispenser of claim 25 wherein the actuation structure comprises a ramp surface operable to induce the movable support structure from the first condition to the second condition when the manual actuator is repositioned from the first position to the second position.

32. The utensil dispenser of claim 31 wherein the movable support structure comprises first and second members disposed in opposition, wherein each of the first and second members has a distal portion, wherein the distal portions of the first and second members are disposed in proximity when the movable support structure is in the first condition, and wherein the distal portions of the first and second members are moved away from one another when the movable support structure is in the second condition and wherein the actuation structure comprises first and second ramp surfaces that progressively increase in effective distance between the ramp surfaces.

33. A utensil dispenser for selectively dispensing a lowermost utensil from a stack of utensils loaded within the utensil dispenser wherein each utensil has a working end with a distal tip and a handle portion with a proximal end, the utensil dispenser comprising:

plural dispensing chambers;

a main housing for retaining the plural dispensing chambers;

each dispensing chamber comprising:

a utensil channel in the dispensing chamber adapted to receive and retain the stack of utensils wherein the utensil channel has a dispensing portion, wherein the utensil channel has a shape corresponding to a peripheral shape of the working end of the utensil, wherein the utensil channel has a longitudinal slot contiguous with the shape corresponding to the peripheral shape of the working end of the utensil, the longitudinal slot for receiving the handle portions of the utensils of the stack of utensils;

a dispensing mechanism selectively operable relative to the dispensing portion of the utensil channel to dispense the lowermost utensil from the stack of utensils, the dispensing mechanism comprising:

a movable support structure comprising first and second movable members disposed in opposition wherein each movable member has a distal portion, wherein the distal portions of the movable members are disposed in proximity when the movable support structure is in a first condition with respect to the dispensing portion of the utensil channel to support the lowermost utensil, and wherein the distal portions of the movable members are moved away from one another when the movable support structure is in a second condition with respect to the dispensing portion of the utensil channel so that the first and second movable members do not provide support to the lowermost utensil;

a manual actuator selectively repositionable from a first position wherein the manual actuator is not actuated to a second, actuated position wherein the manual actuator is actuated;

an actuated support structure retained by the manual actuator to move from a first position wherein the actuated support structure is not disposed to support the stack of utensils to a second position wherein the actuated support structure is interposed between the lowermost utensil and a second lowermost utensil above the lowermost utensil to provide support to the stack of utensils above the lowermost utensil by direct support of the second lowermost utensil; and an actuation structure retained by the manual actuator to move into engagement with the first and second movable members of the movable support structure when the manual actuator is repositioned from the first condition to the second condition wherein the actuation structure is operable to induce the first and second members of the movable support structure from the first condition to the second condition when the manual actuator is repositioned from the first condition to the second condition;

whereby, when the manual actuator is in the actuated position, the stack of utensils above the lowermost utensil is supported by the actuated support structure while the lowermost utensil is supported by neither the movable support structure nor the actuated support structure.

34. The utensil dispenser of claim 33 wherein the actuation structure comprises first and second ramp surfaces that progressively increase in distance between the ramp surfaces, the ramp surfaces operable to be interposed between the first and second movable members of the movable support structure and to induce the first and second movable members of the movable support structure from the first condition to the second condition when the manual actuator is repositioned from the first position to the second position.

35. The utensil dispenser of claim 33 further comprising a fixed support structure in the dispensing portion of the utensil channel spaced from the dispensing mechanism, the fixed support structure operative to support the lowermost utensil of the stack of utensils spaced from the dispensing mechanism.

36. The utensil dispenser of claim 35 wherein the fixed support structure is disposed to support the distal tip of the working end of the lowermost utensil, and wherein the movable support structure and the actuated support structure are disposed to move in alignment with longitudinals of the handle portions of the utensils of the stack of utensils.

* * * * *